US008075287B2

(12) United States Patent
Inoue

(10) Patent No.: US 8,075,287 B2
(45) Date of Patent: Dec. 13, 2011

(54) FLUID PUMP HAVING PLUNGER AND METHOD OF MONOBLOCK CASTING FOR HOUSING OF THE SAME

(75) Inventor: Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 1084 days.

(21) Appl. No.: 11/529,590

(22) Filed: Sep. 29, 2006

(65) Prior Publication Data

US 2007/0071614 A1 Mar. 29, 2007

(30) Foreign Application Priority Data

Sep. 29, 2005 (JP) ..... 2005-283941
Jul. 28, 2006 (JP) ..... 2006-206175

(51) Int. Cl.
*F04B 39/10* (2006.01)
*F04B 53/10* (2006.01)

(52) U.S. Cl. ..... 417/571; 417/454

(58) Field of Classification Search ..... 417/454, 417/571, 572

See application file for complete search history.

(56) References Cited

U.S. PATENT DOCUMENTS 3,372,648 A * 3/1968 Hammelmann ..... 417/567
4,618,316 A * 10/1986 Elliott ..... 417/454
5,059,099 A 10/1991 Cyphers
5,567,134 A * 10/1996 Inoue ..... 417/490
5,603,303 A 2/1997 Okajima et al.
6,332,761 B1 * 12/2001 Guentert et al. ..... 417/490
6,390,072 B1 5/2002 Breeden
6,446,604 B1 9/2002 Guentert et al.
6,460,510 B1 10/2002 Breeden
6,622,706 B2 9/2003 Breeden
6,631,706 B1 10/2003 Yamada et al.
6,662,784 B1 12/2003 Breeden
6,792,968 B1 9/2004 Breeden
6,807,896 B2 * 10/2004 Inoue ..... 92/165 R
2003/0089343 A1 5/2003 Yamaguchi et al.
2003/0103853 A1 * 6/2003 Asayama et al. ..... 417/470
2003/0175137 A1 * 9/2003 Inoue ..... 417/470
2003/0235508 A1 * 12/2003 Vicars ..... 417/360
2004/0055580 A1 3/2004 Yamada et al.

(Continued)

FOREIGN PATENT DOCUMENTS

EP 1557559 A1 7/2005
JP 2004-138062 5/2004

OTHER PUBLICATIONS

EPO Search Report dated Jan. 12, 2007.

(Continued)

*Primary Examiner* — Devon C Kramer
*Assistant Examiner* — Peter J Bertheaud
(74) *Attorney, Agent, or Firm* — Nixon & Vanderhye PC

(57) ABSTRACT

A fluid pump includes a plunger that is movable to pressurize fluid drawn from an inlet into a compression chamber. The plunger is substantially axially movable in a cylinder. Fluid pressurized in the compression chamber is discharged through an outlet. The inlet and the outlet define a fluid passage therebetween. A solenoid valve communicates and blocks the fluid passage to control fluid discharged through the outlet. A solenoid valve support supports the solenoid valve. At least one of the inlet, the outlet, and the solenoid valve support is formed of a ferrous material integrally with the cylinder by monoblock casting.

6 Claims, 25 Drawing Sheets

U.S. PATENT DOCUMENTS

2004/0161353 A1* 8/2004 Fabbri ..... 417/569

OTHER PUBLICATIONS

European Office Action dated Sep. 29, 2009, issued in corresponding European Application No. 06 121 433.4-2311.

European Office Action dated Jul. 30, 2010, issued in corresponding European Application No. 06 121 433.4-2311.

European Office Action dated May 10, 2010, issued in corresponding European Application No. 06 121 433.4-2311.

Extended European Search Report dated Oct. 5, 2010, issued in counterpart European Application No. 10170433.6-2311.

* cited by examiner

FLUID PUMP HAVING PLUNGER AND METHOD OF MONOBLOCK CASTING FOR HOUSING OF THE SAME

CROSS REFERENCE TO RELATED APPLICATIONS

This application is based on and incorporates herein by reference Japanese Patent Applications No. 2005-283941 filed on Sep. 29, 2005 and No. 2006-206175 filed on Jul. 28, 2006.

FIELD OF THE INVENTION

The present invention relates to a fluid pump having a plunger and a method of monoblock casting for a housing of the fluid pump.

BACKGROUND OF THE INVENTION

According to U.S. Pat. No. 5,603,303 (JP-A-8-14140), a high pressure pump includes a cylinder that movably accommodates a plunger for pressurizing fuel in a compression chamber.

As referred to an example depicted in FIG. 26, a high pressure pump 500 includes a plunger 510, which is movable in a cylinder 520, and a solenoid valve (control valve) 550, which is sustained by a solenoid valve support 560. The high pressure pump 500 is mounted to an external member such as an engine head cover via a flange 570. The high pressure pump 500 further includes an inlet 530, an outlet 540. In this structure, the cylinder 520, the inlet 530, the outlet 540, the solenoid valve support 560, and the flange 570 are separate from each other, and are assembled with each other.

As referred to an example depicted in FIG. 27, a high pressure pump 580 includes a cylinder 584, through which the plunger 510 is movable, the inlet 530, the outlet 540, the solenoid valve support 560, and the flange 570. These components of the high pressure pump 580 are separate from each other, and are assembled to each other.

The high pressure pump 500, 580 includes a large number of components. Consequently, an assembling work of the high pressure pump is complicated. In addition, a large number of sealing members are necessary for sealing components, which are connected with each other, for restricting fuel from leaking.

SUMMARY OF THE INVENTION

In view of the foregoing and other problems, it is an object of the present invention to produce a fluid pump having a plunger, the fluid pump being reduced in number of components. It is another object of the present invention to produce a method of monoblock casting for a housing of the fuel pump.

According to one aspect of the present invention, a fluid pump includes an inlet. The fluid pump further includes a plunger that is movable to pressurize fluid drawn from the inlet into a compression chamber. The fluid pump further includes a cylinder in which the plunger is substantially axially movable. The fluid pump further includes an outlet through which fluid pressurized in the compression chamber is discharged. The inlet and the outlet define a fluid passage therebetween. The fluid pump further includes a control valve that communicates and blocks the fluid passage to control fluid discharged through the outlet. The fluid pump further includes a support member that sustains the control valve. At least one of the inlet, the outlet, and the support member is formed of a ferrous material integrally with the cylinder by monoblock casting.

According to another aspect of the present invention, a fluid pump includes an inlet. The fluid pump further includes a plunger that is movable to pressurize fluid drawn from the inlet into a compression chamber. The fluid pump further includes a cylinder in which the plunger is substantially axially movable. The fluid pump further includes an outlet through which fluid pressurized in the compression chamber is discharged. The inlet and the outlet define a fluid passage therebetween. The fluid pump further includes a control valve that communicates and blocks the fluid passage to control fluid discharged through the outlet. The fluid pump further includes a first support member that sustains the control valve. The fluid pump further includes a relief valve that controls pressure of fluid discharged through the outlet. The fluid pump further includes a second support member that sustains the relief valve. At least one of the inlet, the first support member, and the second support member is formed integrally with both the outlet and the cylinder by monoblock casting.

According to another aspect of the present invention, a fluid pump includes an inlet. The fluid pump further includes a plunger that is movable to pressurize fluid drawn from the inlet into a compression chamber. The fluid pump further includes a cylinder in which the plunger is substantially axially movable. The fluid pump further includes an outlet through which fluid pressurized in the compression chamber is discharged. The inlet and the outlet define a fluid passage therebetween. The fluid pump further includes a check valve that permits fluid to be discharged through the outlet. The check valve restricts fluid from flowing into the compression chamber from the outlet. The fluid pump further includes a control valve that communicates and blocks the fluid passage to control fluid discharged through the outlet. The fluid pump further includes a support member that sustains the control valve. At least two of the inlet, the outlet, and the support member are integrally formed.

According to another aspect of the present invention, a fluid pump includes a housing that includes an inlet, an outlet, a cylinder, and a support member. The inlet and the outlet define a fluid passage therebetween. The cylinder has one end that at least partially defines a compression chamber in which fluid is pressurized. The fluid is discharged from the compression chamber through the outlet. The fluid pump further includes a plunger that is substantially axially movable in the cylinder to pressurize fluid drawn from the inlet into the compression chamber. The fluid pump further includes a control valve that communicates and blocks the fluid passage to control fluid discharged through the outlet. The control valve is sustained by the support member. At least one of the inlet, the outlet, the cylinder, and the support member is formed of a ferrous material integrally with the housing by monoblock casting.

According to another aspect of the present invention, a method for monoblock casting a housing of a fluid pump includes forming a wax model that is in a shape of the housing integrated with at least one of a fluid inlet, a fluid outlet, a plunger cylinder, and an external device support. The method further includes applying a fire-resistive material to the wax model so as to form a casting die around the wax model. The method further includes heating the casting die so as to remove the wax model away from the casting die. The method further includes pouring a ferrous material, which is in a molten state, into the casting die.

According to another aspect of the present invention, a method for monoblock casting a housing of a fluid pump includes forming a plurality of wax models each being in a shape of the housing integrated with at least one of a fluid inlet, a fluid outlet, a plunger cylinder, and an external device support. The method further includes connecting the plurality of wax models with a wax runner so as to assemble a wax tree. The method further includes applying fire-resistive slurry and fire-resistive stucco alternately to the wax tree so as to form a casting die around the wax tree. The method further includes heating the casting die so as to remove the wax tree away from the casting die. The method further includes calcinating the casting die. The method further includes pouring a ferrous material, which is in a molten state, into the casting die.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
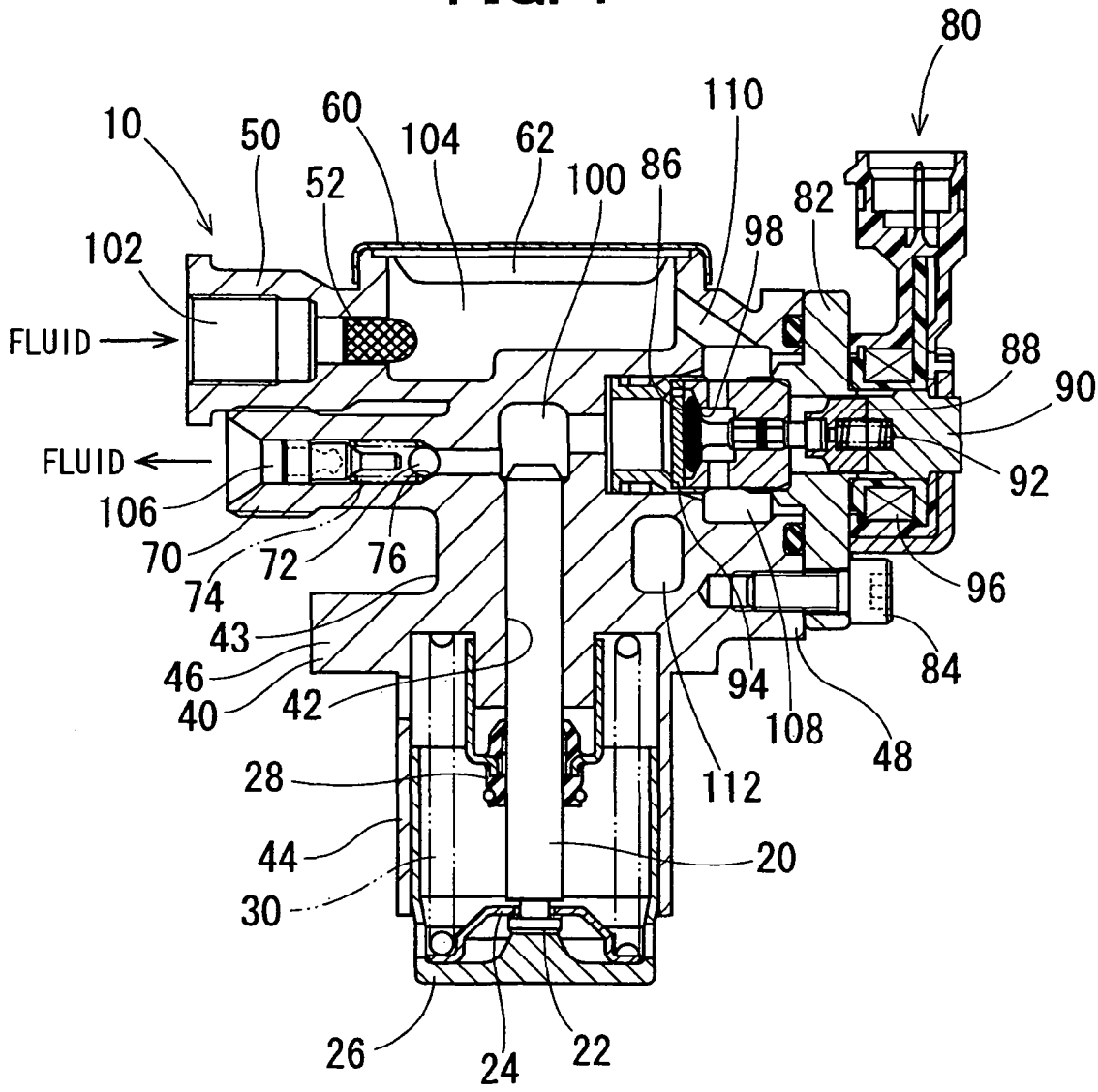
FIG. 1 is a partially longitudinal sectional view showing a high pressure pump according to a first embodiment.

As shown in FIG. 1, a high pressure pump 10 supplies fuel into an injector for an internal combustion engine such as a diesel engine and a gasoline engine.

A plunger 20 is axially movable in a cylinder (plunger cylinder) 42 of a pump housing 40. The cylinder 42 has one end with respect to the movable direction of the plunger 20. The one end of the cylinder 42 defines a compression chamber 100. An oil seal 28 is formed around the outer circumferential periphery of the plunger 20 between a head 22 and the cylinder 42. The oil seal 28 restricts intrusion of oil from the inside of the engine into the compression chamber 100. The oil seal 28 also restricts leakage of fuel from the compression chamber 100 into the engine. The head 22 is provided to the other end of the plunger 20. The head 22 connects with a spring seat 24. The spring seat 24 is biased onto the inner periphery of the bottom wall of a tappet 26 by bias force of a spring 30. The outer periphery of the bottom wall of the tappet 26 slides relative to a pump cam (not shown) by rotation of the pump cam, so that the plunger 20 axially moves. The tappet 26 is guided by the inner circumferential periphery of a tappet guide 44 such that the tappet 26 is axially movable.

The pump housing 40 is constructed of the cylinder 42, the tappet guide 44, a flange 46, a solenoid valve support (support member, external device support) 48, an inlet (fluid inlet) 50, and an outlet (fluid outlet) 70. The pump housing 40 is formed of a ferrous material such as stainless steel by monoblock casting. The pump housing 40 is hardened by quenching after being formed by the monoblock casting, for example. When the high pressure pump 10 is applied to a diesel engine, the pump housing 40 may be cast of a ferrous material other than stainless steel. The pump housing 40 has a wall thickness that is equal to or greater than 0.5 mm in order to resist to fuel in high pressure such as tens to hundreds of MPa.

The pump housing 40 may have a cavity 112 formed by removing a portion, which is unnecessary for producing mechanical strength. The cavity 112 is formed when the pump housing 40 is formed by casting. The solenoid valve support 48, the inlet 50, and the outlet 70 outwardly extend from the outer circumferential periphery 43 of the cylinder 42. The solenoid valve support 48 supports a solenoid valve 80 by being connected with the solenoid valve 80 via a screw member such as a bolt 84, instead of being screwed with the solenoid valve 80.

The inlet 50 accommodates a fuel filter 52. The filter 52 removes foreign matters contained in fuel drawn through an inlet passage 102. Fuel is introduced into an inlet chamber 104 through the inlet passage 102. The inlet chamber 104 is defined by a concavity formed in the pump housing 40. The inlet chamber 104 is located on a substantially opposite side of the plunger 20 with respect to the axial direction of the plunger 20 such that the inlet chamber 104 and the plunger 20 interpose the compression chamber 100 therebetween. The inlet chamber 104 is substantially coaxial with respect to the plunger 20. The inlet chamber 104 extends with respect to the radial direction of the compression chamber 100.

The inlet chamber 104 is surrounded by a cover 60. The cover 60 and the pump housing 40 interpose a pulsation damper 62 therebetween. The pulsation dumper 62 elastically deforms in accordance with fuel pressure in the inlet chamber 104, so that pulsation in pressure of fuel, which flows into the inlet chamber 104 through the inlet passage 102, reduces.

The outlet 70 also serves as a joint, which connects with the high pressure pipe. The outlet 70 also serves as a delivery valve, which has an operation of a check valve. The outlet 70 has an outlet passage 106 that accommodates a ball 72 and a spring 74. The spring 74 biases the ball 72 onto a valve seat 76. The ball 72 is adapted to be seated onto the valve seat 76 that is integrally formed with the pump housing 40. The ball 72, the spring 74, and the valve seat 76 construct the delivery valve serving as the check valve. When pressure in the compression chamber 100 becomes equal to or greater than predetermined pressure, the ball 72 is lifted from the valve seat 76 against the bias force of the spring 74, so that high pressure fuel in the compression chamber 100 is discharged from the outlet 70 through the outlet passage 106. When the ball 72 is seated onto the valve seat 76, fuel is restricted from causing counterflow in a direction from the outlet 70 into the compression chamber 100.

The solenoid valve 80 has a valve housing 82 that is connected with the solenoid valve support 48 via the bolt 84, so that the solenoid valve 80 is supported by the solenoid valve support 48. The solenoid valve 80 is located on the lateral side of the high pressure pump 10. The solenoid valve 80 includes a coil 96. The solenoid valve 80 communicates a fuel gallery 108 with the compression chamber 100 by supplying electricity to the coil 96. The solenoid valve 80 blocks the fuel gallery 108 from the compression chamber 100 by terminating the electricity supplied to the coil 96. The solenoid valve 80 serves as a control valve. The solenoid valve 80 controls an amount of fuel discharged from the high pressure pump 10 by controlling timing of supplying electricity to the coil 96. The fuel gallery 108 communicates with the inlet chamber 104 through a communication passage 110.

The solenoid valve 80 has a valve member 86 that is axially movable together with a moving core 88. The valve member 86 and the moving core 88 are biased by the spring 92 such that the valve member 86 and the moving core 88 are spaced from a stationary core 90. The valve member 86 is applied with the bias force from the spring 92, so that the valve member 86 hooks to the stopper plate 94. The stopper plate 94 and the valve member 86 define a fuel passage therebetween in a condition in which the valve member 86 hooks to the stopper plate 94, so that the fuel gallery 108 communicates with the compression chamber 100 through the fuel passage. The valve member 86 hooks to the stopper plate 94 by the bias force applied from the spring 92 when electricity supplied to the coil 96 is terminated. The moving core 88 is attracted to the stationary core 90 against the bias force of the spring 92, when electricity is supplied to the coil 96. Thus, the valve member 86 is lifted from the stopper plate 94 together with the moving core 88, and is seated onto a valve seat 98. The fuel gallery 108 is blocked from the compression chamber 100 when the valve member 86 is seated onto the valve seat 98.

As follows, a manufacturing process of the pump housing 40 is described in reference to FIGS. 2A to 2I in order.

Figure 2A:
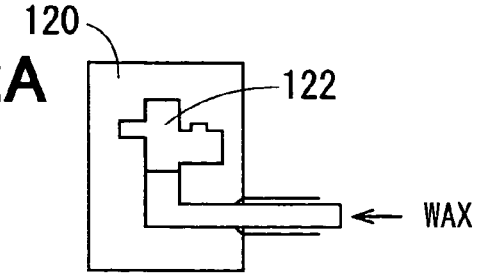
FIGS. 2A to 2I are schematic views showing a process for manufacturing a pump housing of the high pressure pump.

As shown in FIG. 2A, wax is injected into a die 120 of the pump housing 40, so that a model (wax model) 122 of the pump housing 40 is molded in the die 120.

Figure 2B:
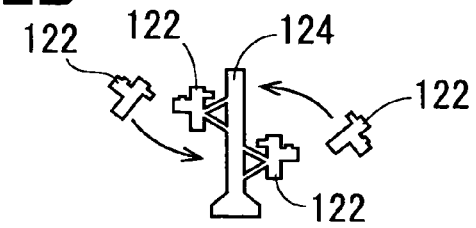

As shown in FIG. 2B, a runner channel (sprue runner, wax runner) 124 is formed of wax, and the sprue runner 124 is connected with the models 122, so that a tree (wax tree) 126 is formed.

Figure 2C:
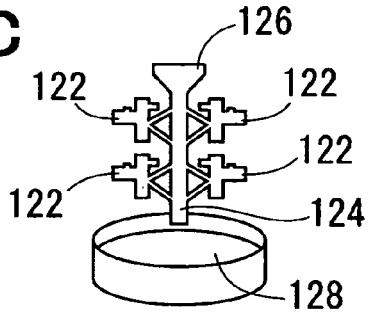

As shown in FIG. 2C, the tree 126 is submerged into a slurry 128. The slurry 128 is produced by mixing fire-resistive bond, which is in liquid form, and fire-resistive powder.

Figure 2D:
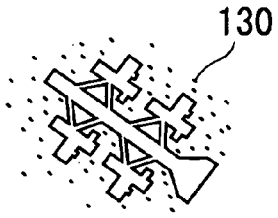

As shown in FIG. 2D, the tree 126, which is submerged in the slurry 128, is pulled out of the slurry 128, and stucco 130 is applied on the surface of the tree 126 covered with the slurry 128. The stucco 130 is fire-resistive sand, for example.

In the above processes described in reference to FIGS. 2C, 2D, the slurry 128 and the stucco 130 covering the tree 126 form a mold (casting die) 132. These processes in FIGS. 2C, 2D are repeated for several times, so that the thickness of the casting die 132 is increased to a predetermined degree.

Figure 2E:
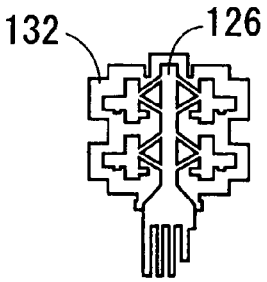

As shown in FIG. 2E, the casting die 132 is exposed to high-temperature and high-pressure steam, so that the tree 126 in the casting die 132 is melt away.

Figure 2F:
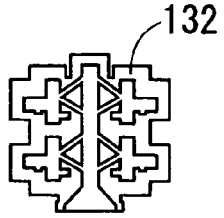

As shown in FIG. 2F, the casting die 132 is applied with fire, and calcinated, so that the casting die 132 is enhanced in strength.

Figure 2G:
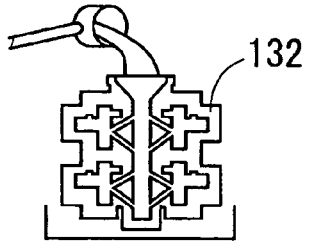

As shown in FIG. 2G, molten metal is poured into the casting die 132, so that a base material tree 134 of the pump housing 40 is cast in the casting die 132. The casting die 132 is applied with vibration after completing the poring of the molten metal into the casting die 132.

Figure 2H:
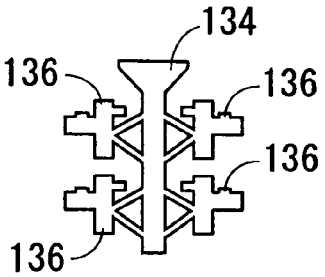

Thus, as shown in FIG. 2H, the casting die 132 is removed from the base material tree 134 of the pump housing 40.

Figure 2I:
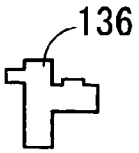

As shown in FIG. 2I, a base material 136, which is formed by casting, is removed from the base material tree 134. The base material 136 is substantially shaped in a form of the pump housing 40, which is an end product. The base material 136 is provided with machining works for forming accurate portions such as a screw hole, a flange surface, the cylinder, and fluid passages, so that the manufacturing process of the pump housing 40 is completed.

Summarizing the method for monoblock casting the housing 40 of the fluid pump 10, the wax model 122 is formed to be in the shape of the housing 40 integrated with at least one of the fluid inlet 50, the fluid outlet 70, the plunger cylinder 42, and the solenoid valve support 48. A fire-resistive material 128 is applied to the wax model 122 so as to form the casting die 132 around the wax model 122. The casting die 132 is heated so as to remove the wax model 122 away from the casting die 132. The ferrous material 134, which is in the molten state, is pored into the casting die 132.

Alternatively, summarizing the method for monoblock casting the housing 40 of the fluid pump 10, the wax models 122 is formed such that each of the wax models 122 is in the shape of the housing 40 integrated with at least one of the fluid inlet 50, the fluid outlet 70, the plunger cylinder 42, and the solenoid valve support 48. The wax models 122 are connected with the wax runner 124 so as to assemble the wax tree 126. Fire-resistive slurry 128 and fire-resistive stucco 130 are alternately applied to the wax tree 126 so as to form the casting die 132 around the wax tree 126. The casting die 132 is heated so as to remove the wax tree 126 away from the casting die 132. The casting die 132 is calcinated. The ferrous material 134, which is in the molten state, is poured into the casting die 132.

As follows, an operation of the high pressure pump 10 is described in reference to FIG. 1.

First, in a suction stroke, supplying electricity to the coil 96 is terminated, and the valve member 86 of the solenoid valve 80 hooks to the stopper plate 94, so that the inlet chamber 104 communicates with the compression chamber 100 in the solenoid valve 80. In this condition, the pump cam rotates, and the plunger moves downward, so that pressure in the compression chamber 100 decreases. Thus, fuel is drawn from the inlet chamber 104 into the compression chamber 100 through the communication passage 110 and the fuel gallery 108.

Second, in a return stroke, when the plunger 20 starts moving upward from the bottom dead center to the top dead center, supplying electricity to the coil 96 is still terminated. In this condition, as the plunger 20 moves upward, fuel in the compression chamber 100 is returned into the inlet chamber 104 through the fuel passage, which is defined between the stopper plate 94 and the valve member 86, the fuel gallery 108, and the communication passage 110.

Third, in a press-feed stroke, the coil 96 of the solenoid valve 80 is supplied with electricity when the plunger 20 is at a predetermined position while the plunger 20 moves from the bottom dead center to the top dead center. The predetermined position of the plunger 20 corresponds to a predetermined amount of fuel, which is press-fed to the engine. The moving core 88 is attracted toward the stationary core 90, so that the valve member 86 is lifted from the stopper plate 94, and is seated onto the valve seat 98. Thus, the inlet chamber 104 is blocked from the compression chamber 100 in the solenoid valve 80. As the plunger 20 further moves upward to the top dead center, fuel in the compression chamber 100 is pressurized. When pressure in the compression chamber 100 becomes equal to or greater than predetermined pressure, the ball 72 is lifted from the valve seat 76 against the bias force of the spring 74, so that high pressure fuel in the compression chamber 100 is discharged through the outlet passage 106.

The high pressure pump 10 pumps fuel by repeating the suction stroke, the return stroke, and the press-feed stroke. The solenoid valve 80 controls the amount of fuel discharged from the high pressure pump 10 by controlling the timing of supplying electricity to the coil 96.

In this embodiment, the pump housing 40 is formed of a ferrous material such as stainless steel by monoblock casting, so that the cylinder 42, the tappet guide 44, the flange 46, the solenoid valve support 48, the inlet 50, and the outlet 70 are integrally formed. Therefore, assembling work of components constructing the pump housing 40 can be reduced, so that manufacturing work of the pump housing 40 can be reduced. Furthermore, sealing need not between components constructing the pump housing 40. Therefore, the number of sealing members can be also reduced. In addition, the number of sealed components can be reduced, so that fuel can be restricted from leaking through sealed components.

The solenoid valve support 48, the inlet 50, and the outlet 70 extend outwardly beyond the cavity 112 and the outer circumferential periphery 43 of the cylinder 42. In this embodiment, the pump housing 40 is formed by casting. Therefore, the empty space around the solenoid valve support 48, the inlet 50, and the outlet 70 can be formed without removing base material by machining work or the like. Thus, the base material can be reduced in consideration of the structure or strength of the high pressure pump 10, so that the high pressure pump 10 can be reduced in size and weight. Therefore, the base material for the high pressure pump 10 can be reduced, and manufacturing cost can be reduced.

The outlet 70 of the high pressure pump is further connected with the high pressure piping. The positions of the outlet 70 and the high pressure piping may not match due to misalignment of the high pressure piping or the like. In general, a high pressure piping has large thickness for supplying high pressure fuel. When misaligned high pressure piping is forcibly aligned to the outlet 70, the pressure piping may be applied with large stress.

Consequently, when a high pressure piping is forcibly connected with the outlet 70, the high pressure piping and the outlet 70 may be applied with large stress for alignment of connection between the high pressure piping and the outlet 70. In this condition, when the cylinder 42 is a component separate from the outlet 70, connection between the cylinder 42 and the outlet 70 may be loosened or damaged due to the stress. Alternatively, when the high pressure piping and the outlet are applied with excessive stress, the connection between the high pressure piping and the outlet 70 may be damaged.

In this embodiment, the outlet 70 is integrally formed with the cylinder 42 by monoblock casting. Therefore, even when the outlet 70 and the high pressure piping are applied with large stress, the cylinder 42 and the outlet 70 can be restricted from being loosened or damaged.

Second and Third Embodiments

Figure 3:
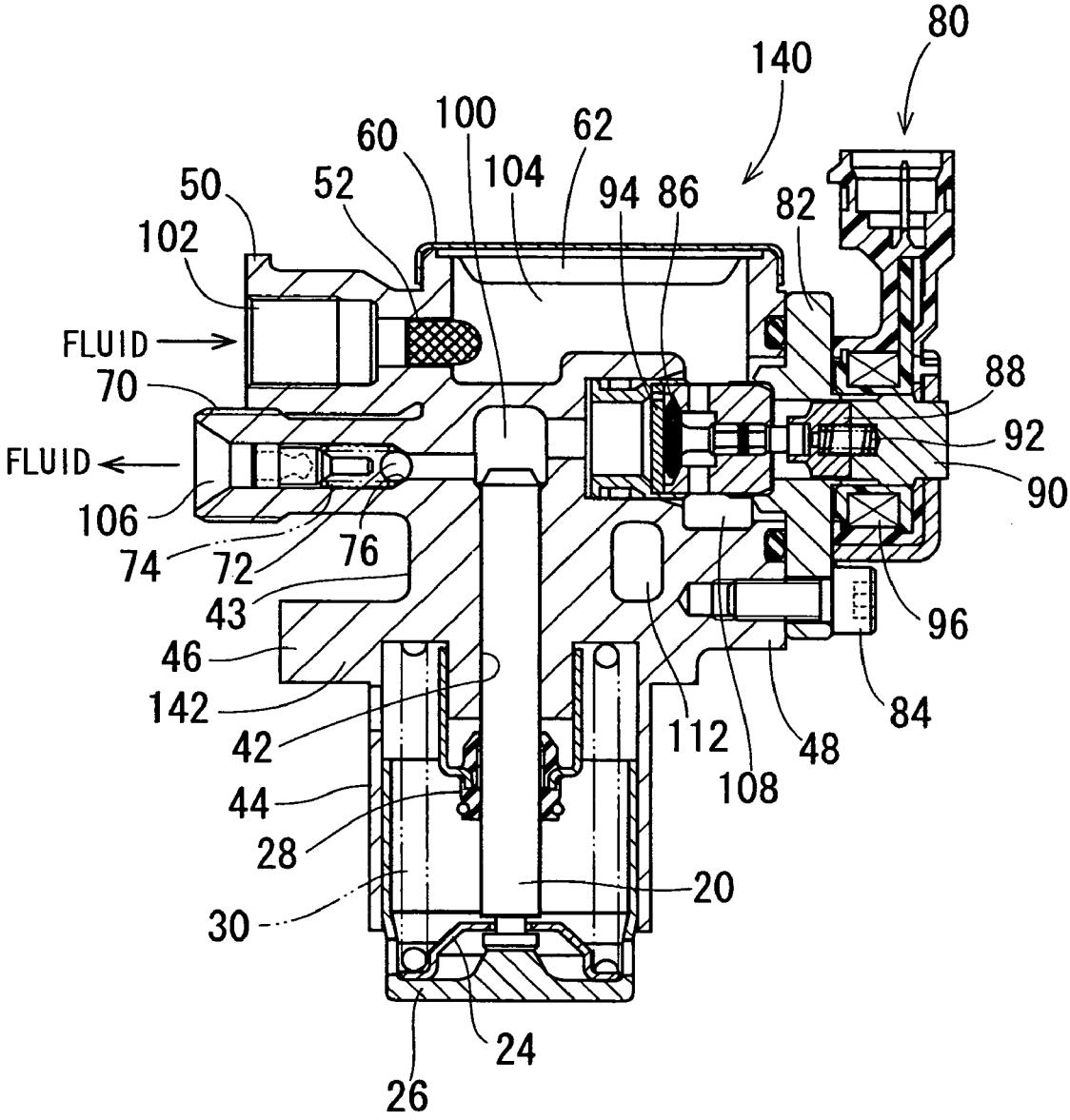
FIG. 3 is a partially longitudinal sectional view showing a high pressure pump according to a second embodiment.

As shown in FIG. 3, in the second embodiment, a high pressure pump 140 includes a pump housing 142. The pump housing 142 includes the cylinder 42, the tappet guide 44, the flange 46, the solenoid valve support 48, the inlet 50, and the outlet 70 that are formed of a ferrous material such as stainless steel by monoblock casting, similarly to the pump housing 40 in the first embodiment. In this embodiment, the inlet chamber 104 is eccentric toward the solenoid valve 80, dissimilarly to the structure of the first embodiment. In this structure, the fuel gallery 108 directly communicates with the inlet chamber 104, dissimilarly to the structure of the first embodiment, in which the fuel gallery 108 communicates with the inlet chamber 104 through the communication passage 110. Therefore, the communication passage 110 need not be formed, so that manufacturing cost can be reduced.

In the structure of the second embodiment, the inlet chamber 104 is eccentrically arranged toward the solenoid valve 80, and the fuel gallery 108 is directly communicated with the inlet chamber 104. This structure of the second embodiment can be readily produced by casting.

Figure 4:
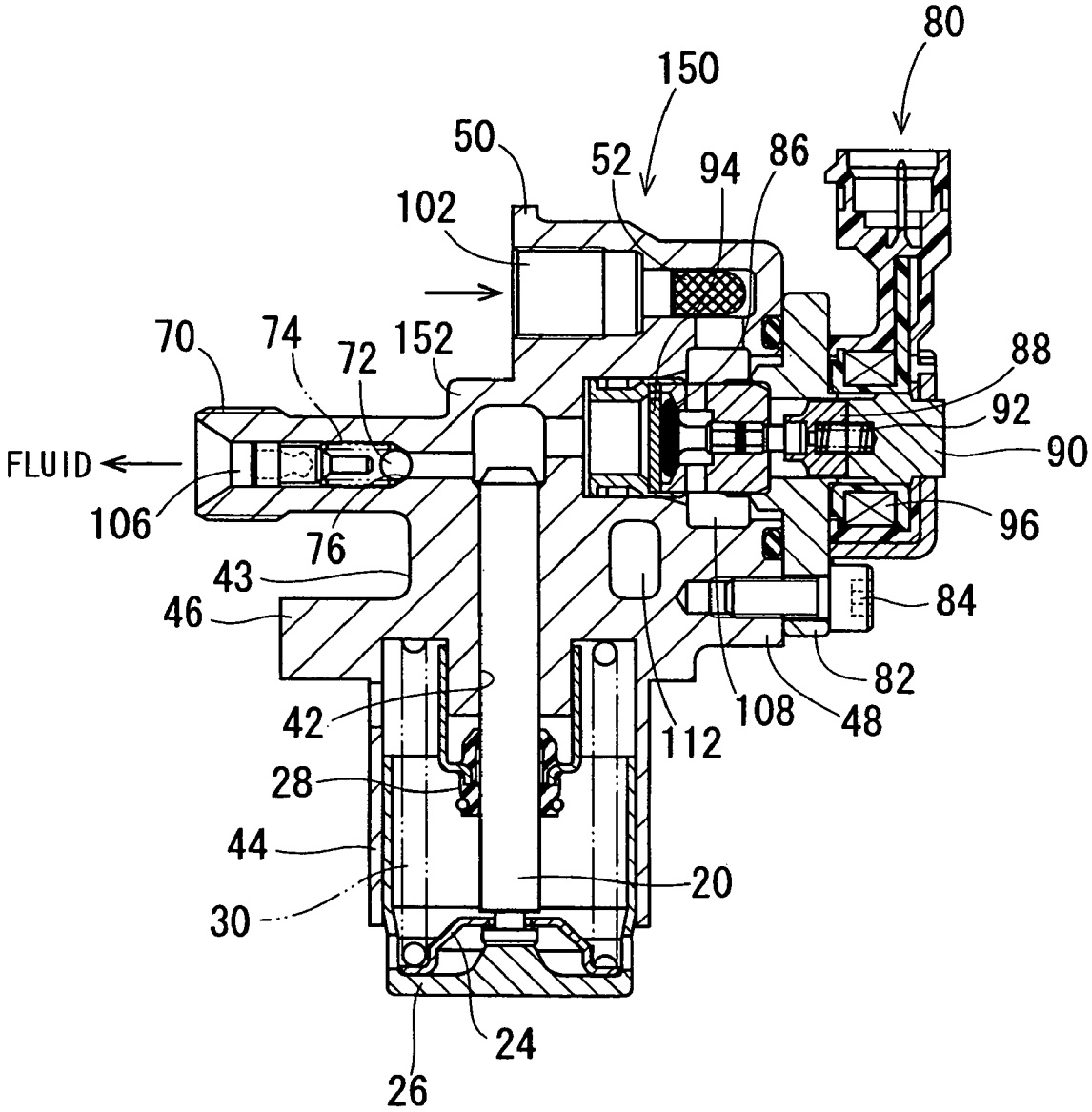
FIG. 4 is a partially longitudinal sectional view showing a high pressure pump according to a third embodiment.

As shown in FIG. 4, in the third embodiment, the inlet chamber 104 is omitted, and the inlet passage 102 of the inlet 50 directly communicates with the fuel gallery 108 without through the inlet chamber 104.

Fourth to Eighth Embodiments

In the fourth to eighth embodiments, high pressure pump 160, 170, 180, 200, 210 includes the solenoid valve 80 that is vertically arranged on the upper side of the high pressure pump 160, 170, 180, 200, 210.

Figure 5:
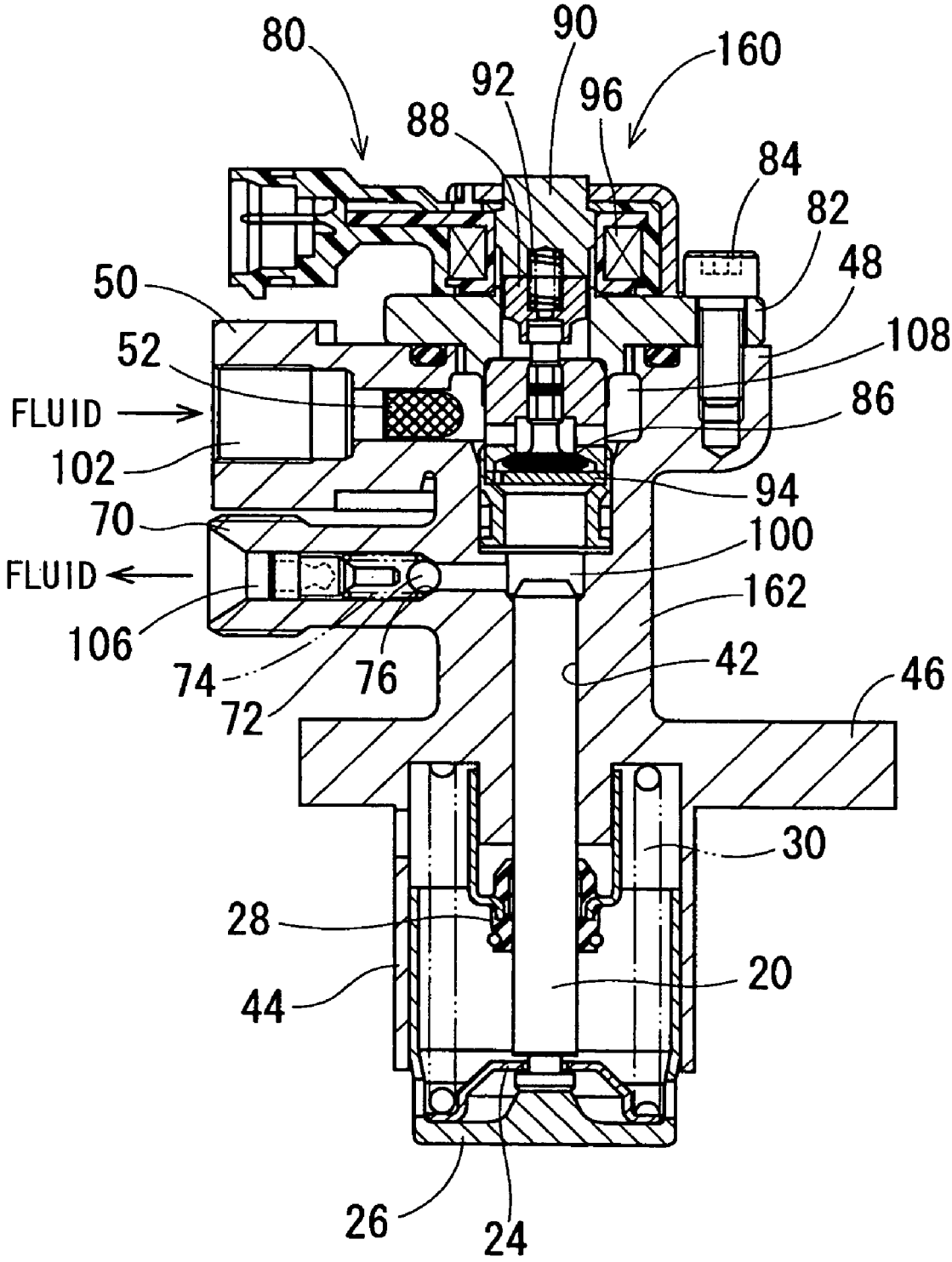
FIG. 5 is a partially longitudinal sectional view showing a high pressure pump according to a fourth embodiment.

As shown in FIG. 5, in the fourth embodiment, a high pressure pump 160 includes a pump housing 162. The pump housing 162 includes the cylinder 42, the tappet guide 44, the flange 46, the solenoid valve support 48, the inlet 50, and the outlet 70 that are formed of a ferrous material such as stainless steel by monoblock casting, similarly to the pump housing 40 in the first embodiment.

Figure 6:
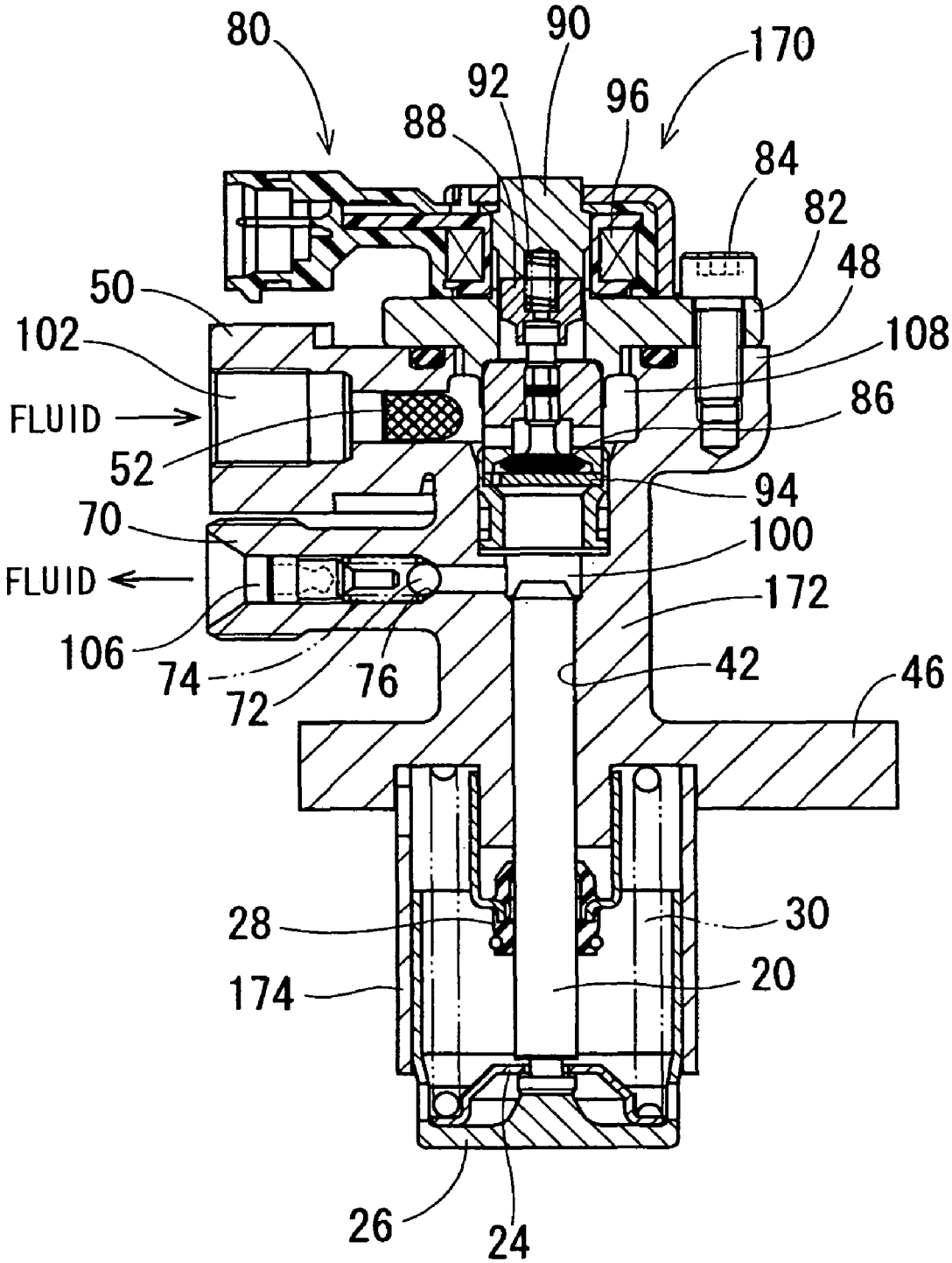
FIG. 6 is a partially longitudinal sectional view showing a high pressure pump according to a fifth embodiment.

As shown in FIG. 6, in the fifth embodiment, a high pressure pump 170 includes a pump housing 172. The pump housing 172 includes the cylinder 42, the flange 46, the solenoid valve support 48, the inlet 50, and the outlet 70 that are formed of a ferrous material such as stainless steel by monoblock casting. A tappet guide 174 is a component separate from the cylinder 42.

Figure 7:
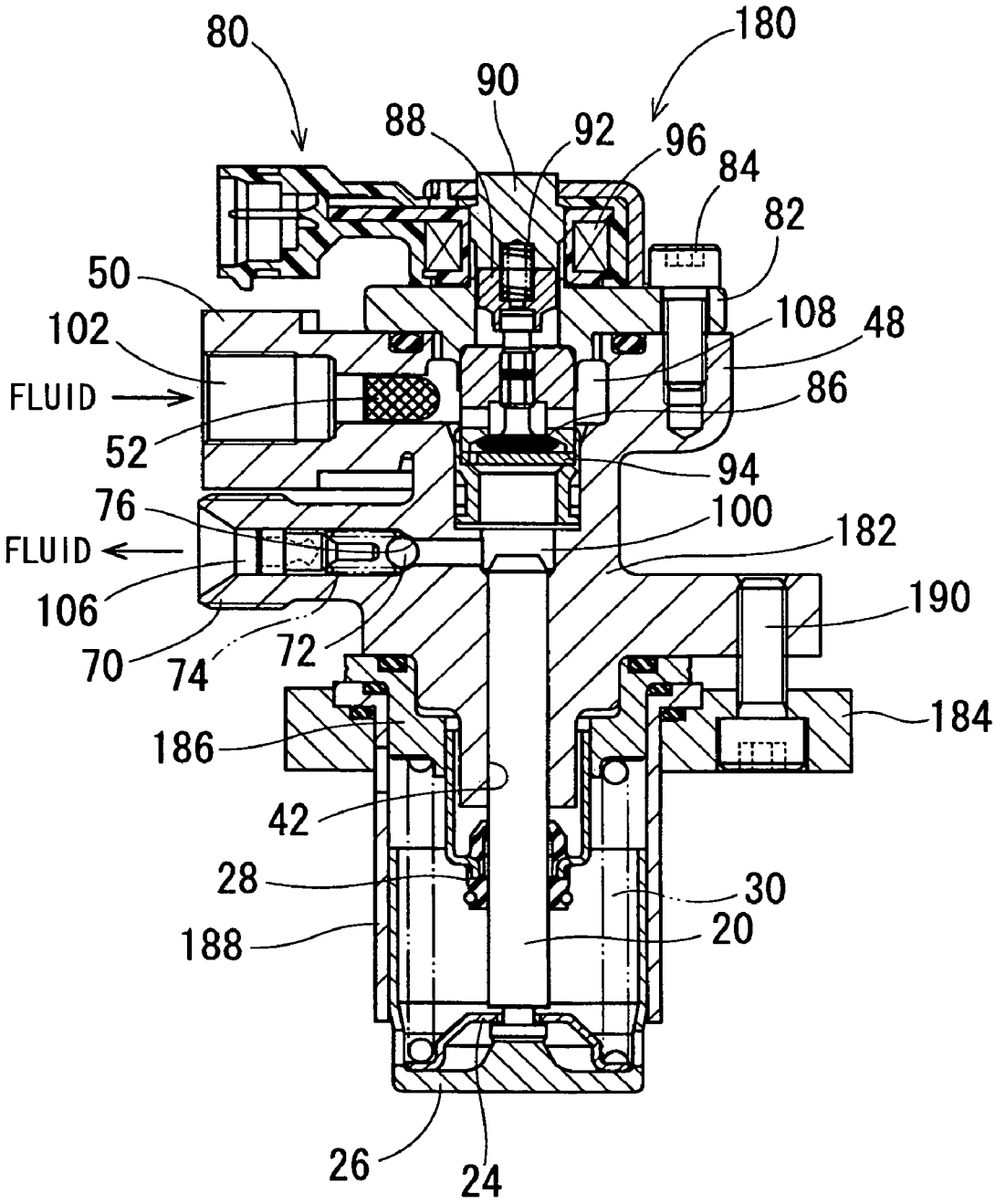
FIG. 7 is a partially longitudinal sectional view showing a high pressure pump according to a sixth embodiment.

As shown in FIG. 7, in the sixth embodiment, a high pressure pump 180 includes a pump housing 182. The pump housing 182 includes the cylinder 42, the solenoid valve support 48, the inlet 50, and the outlet 70 that are formed of a ferrous material such as stainless steel by monoblock casting. A flange 184, a spring seat 186 on the side of the cylinder 42, a tappet guide 188 are components separate from the cylinder 42. The pump housing 182 connects with the flange 184 via a bolt 190.

Figure 8:
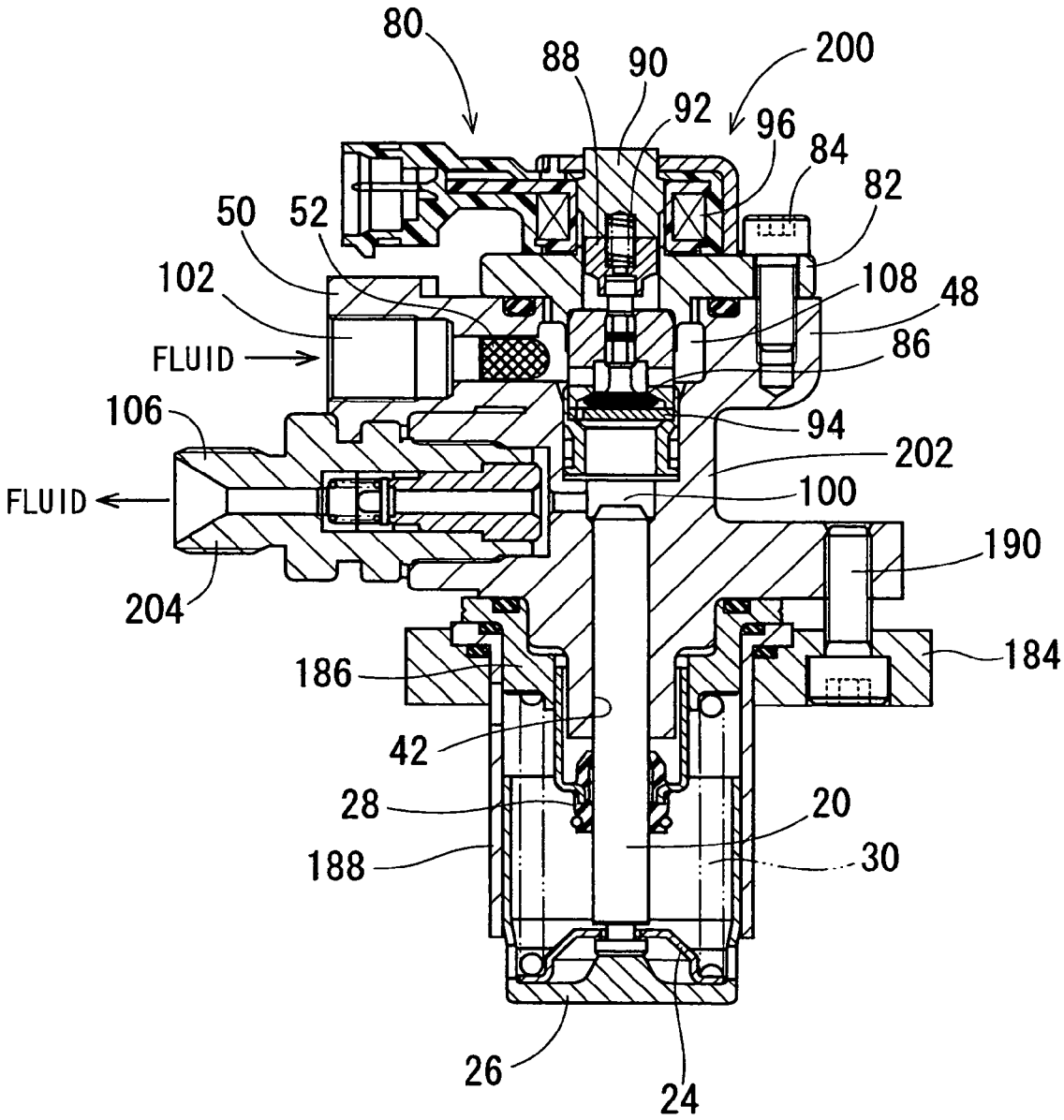
FIG. 8 is a partially longitudinal sectional view showing a high pressure pump according to a seventh embodiment.

As shown in FIG. 8, in the seventh embodiment, a high pressure pump 200 includes a pump housing 202. The pump housing 202 includes the cylinder 42, the solenoid valve support 48, and the inlet 50 that are formed of a ferrous material such as stainless steel by monoblock casting. An outlet 204, the flange 184, the spring seat 186, the tappet guide 188 are components separate from the cylinder 42. The outlet 204 also serves as a delivery valve.

Figure 9:
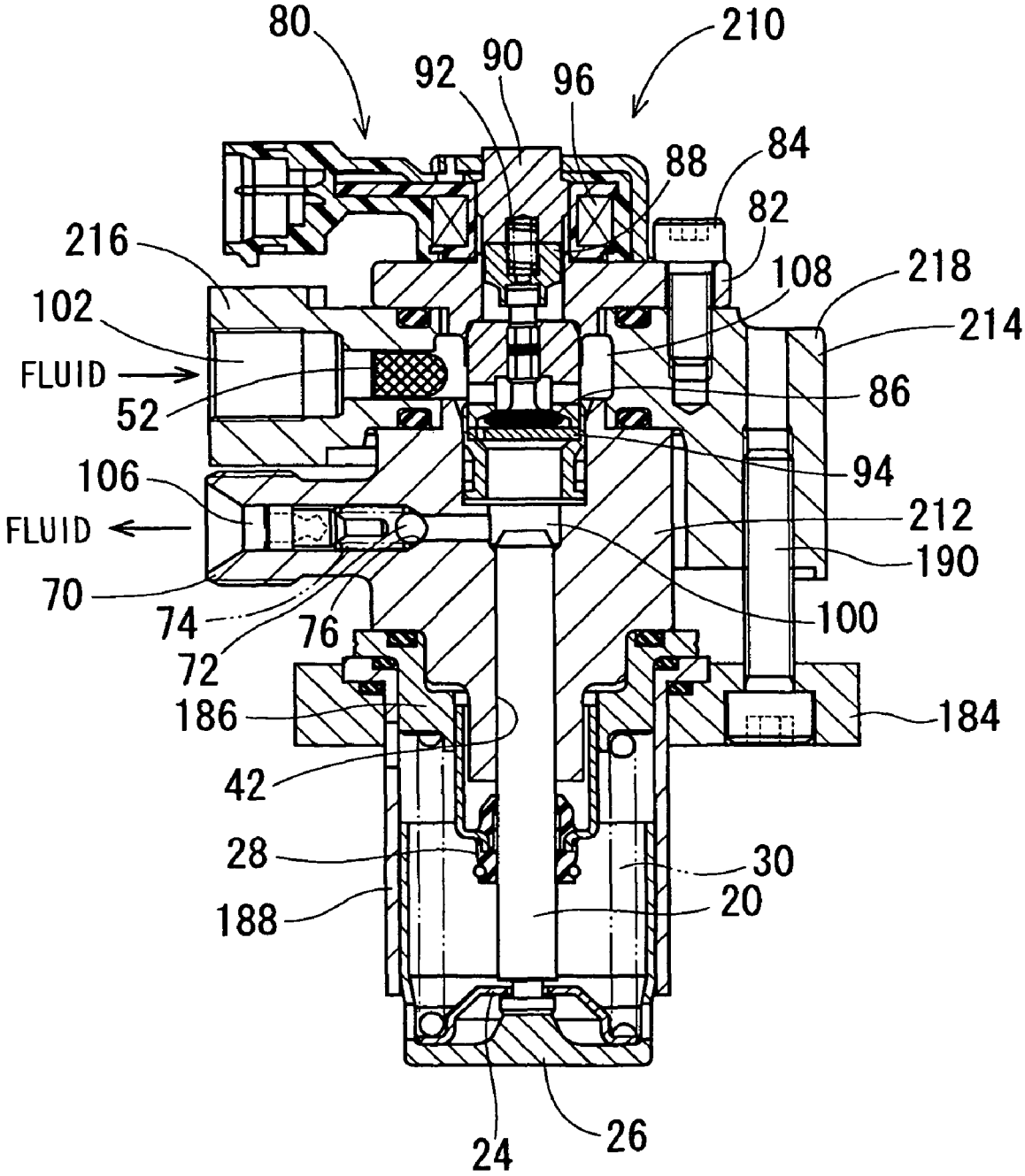
FIG. 9 is a partially longitudinal sectional view showing a high pressure pump according to an eighth embodiment.

As shown in FIG. 9, in the eighth embodiment, a high pressure pump 210 includes a pump housing 212. The pump housing 212 includes the cylinder 42 and the outlet 70 that are formed of a ferrous material such as stainless steel by monoblock casting. An inlet 216, a solenoid valve support (support member, external device support) 218, the flange 184, the spring seat 186, and the tappet guide 188 are components separate from the cylinder 42. The inlet 216 and the solenoid valve support 218 are integrally formed to be a cover 214. The cover 214 connects with the flange 184 via the bolt 190.

Ninth and Tenth Embodiments

Figure 10:
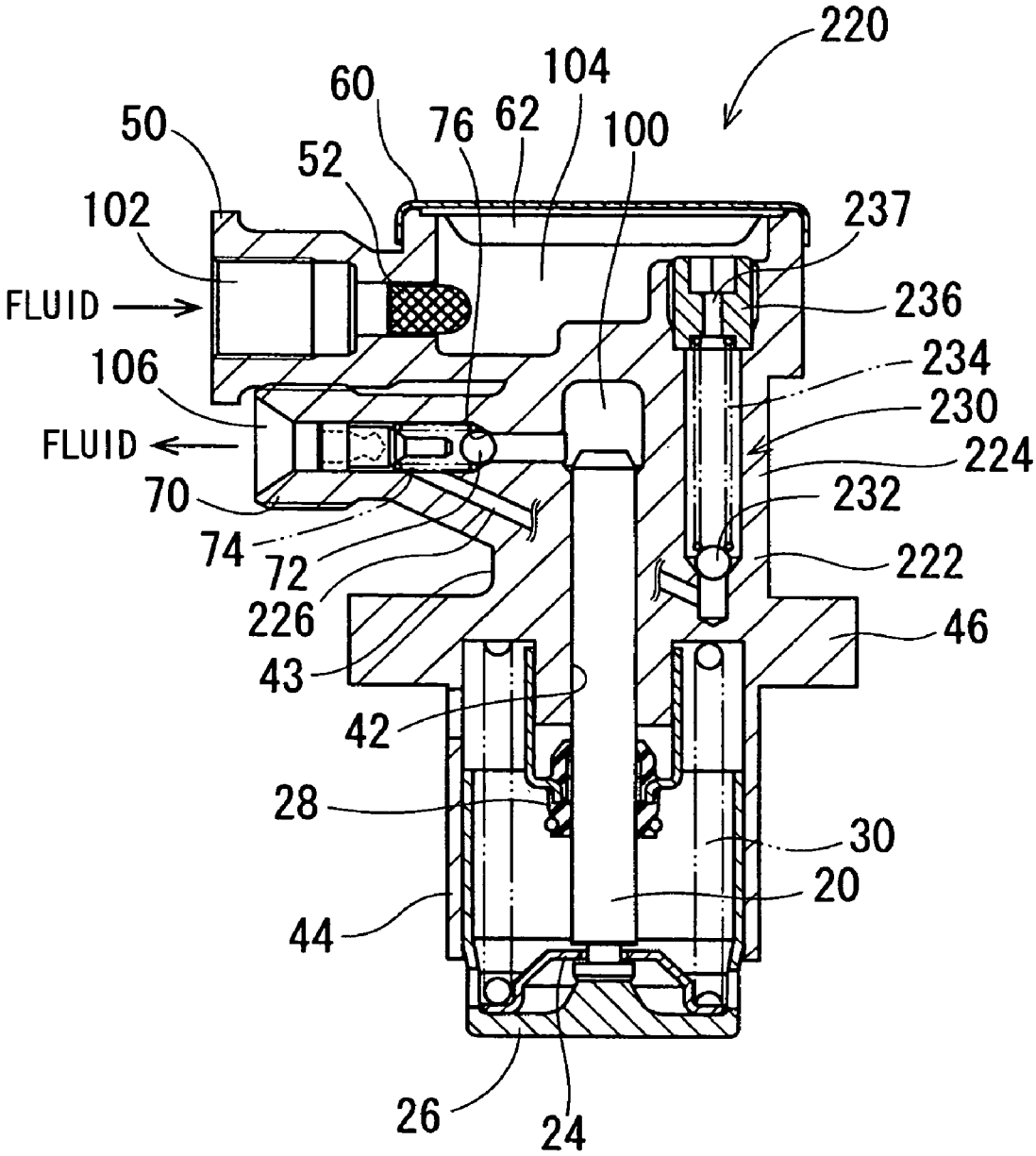
FIG. 10 is a partially longitudinal sectional view showing a high pressure pump according to a ninth embodiment.
Figure 11:
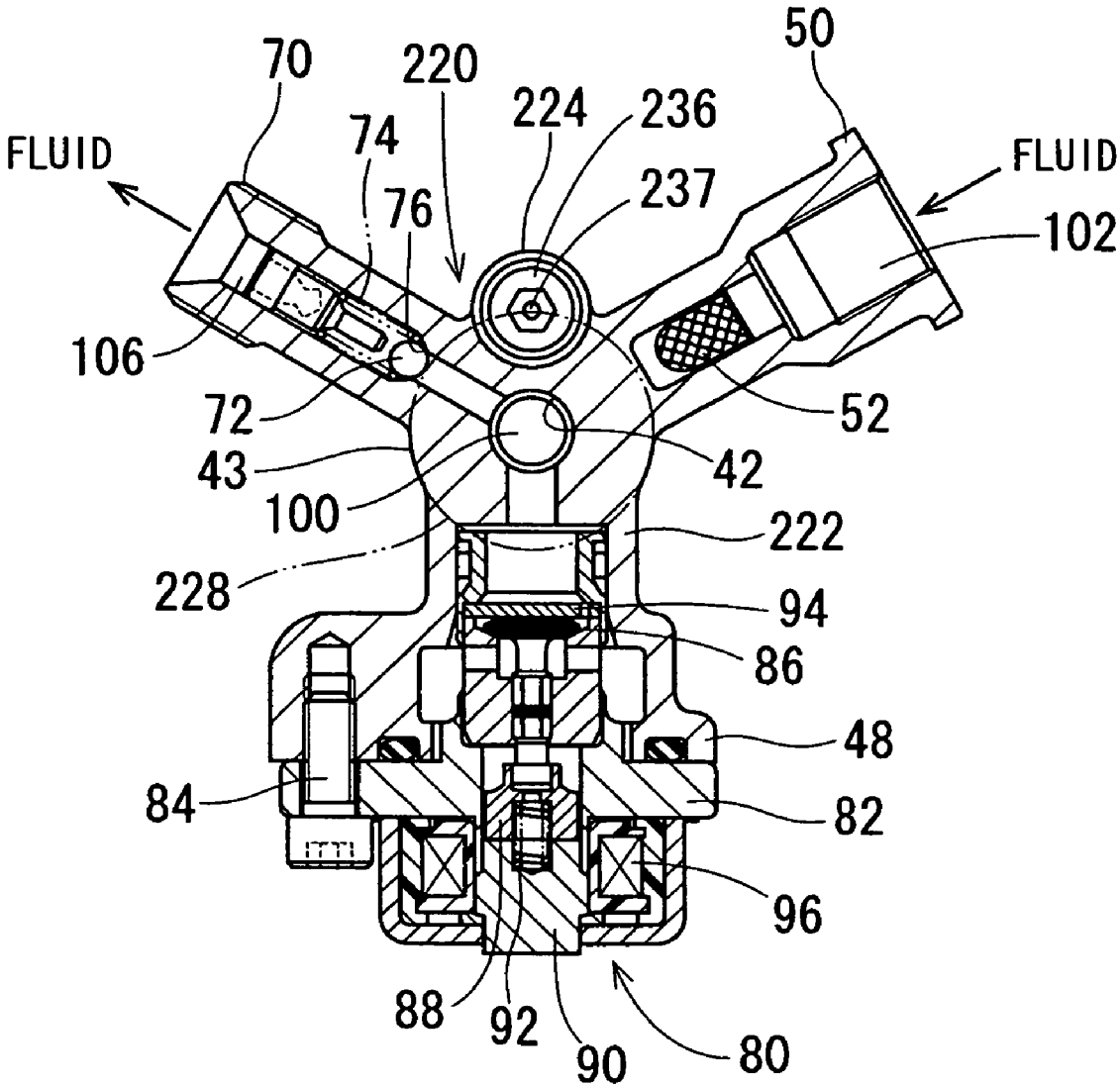
FIG. 11 is a transverse sectional view showing the high pressure pump according to the ninth embodiment.
Figure 12:
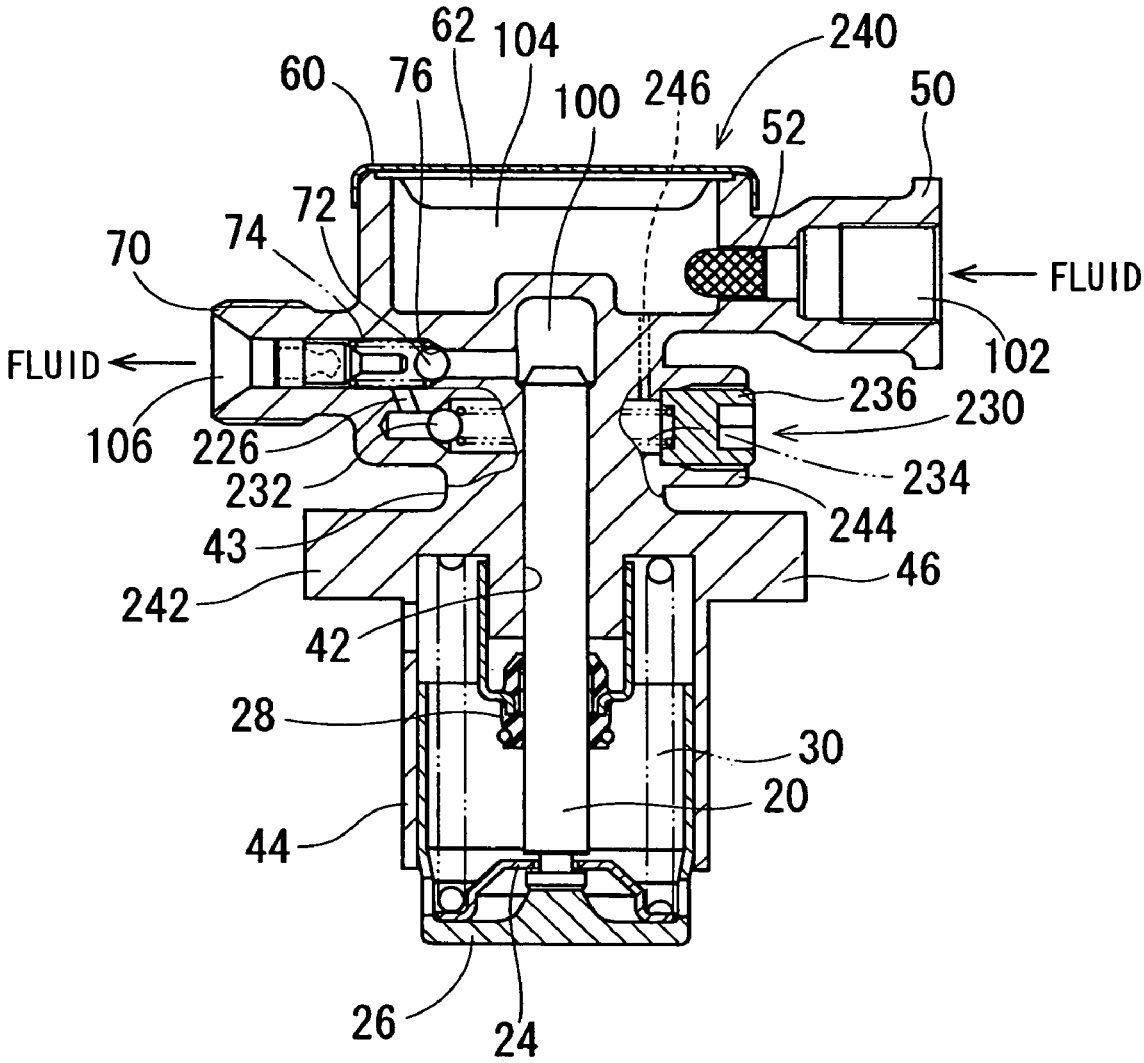
FIG. 12 is a partially longitudinal sectional view showing a high pressure pump according to a tenth embodiment.
Figure 13:
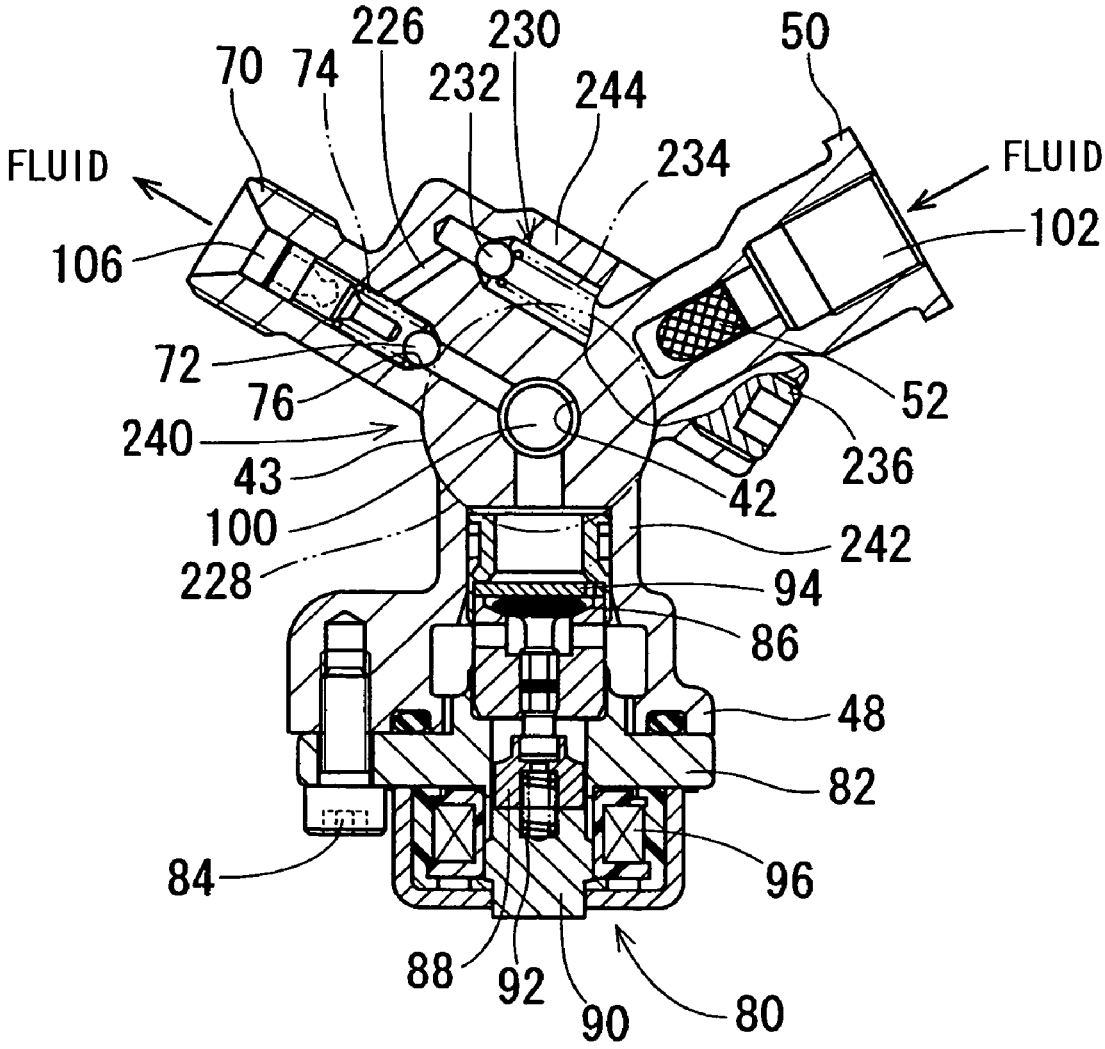
FIG. 13 is a transverse sectional view showing the high pressure pump according to the tenth embodiment.

FIGS. 10 to 13 are sectional views showing a high pressure pump 220, 240. FIGS. 11, 13 are transverse sectional views showing a high pressure pump 220, 240 respectively depicted by cutting the high pressure pump 220, 240 shown in FIGS. 12, 14 at different axial positions to facilitate understanding the structure. In the ninth and tenth embodiments, the high pressure pump 220, 240 respectively include a pump housing 222, 242 having a relief valve 230.

As shown in FIGS. 10, 11, in the ninth embodiment, the high pressure pump 220 includes the pump housing 222. The pump housing 222 includes the cylinder 42, the tappet guide 44, the flange 46, the solenoid valve support 48, the inlet 50, the outlet 70, and a relief valve support (support member, external device support) 224 that are formed of a ferrous material such as stainless steel by monoblock casting. As referred to FIG. 11, the solenoid valve support 48, the inlet 50, and the outlet 70 are arranged circumferentially at substantially regular angular interval. The relief valve support 224 accommodates the relief valve 230 that includes a ball 232, a spring 234, and a spring seat 236.

The relief valve 230 is vertically arranged with respect to the pump housing 222. An outlet passage 226 communicates with the outlet 70 on the downstream of the ball 72. Pressure of fuel in the outlet passage 226 is applied to the ball 232 in the relief valve 230, such that the ball 232 is lifted and the outlet passage 226 communicates with a through hole 237, which is formed in the spring seat 236, so that the relief valve 230 opens. When pressure in the downstream of the ball 72 in the outlet 70 becomes equal to or greater than predetermined pressure, the ball 232 is lifted against the bias force of the spring 234, so that fuel is exhausted from the outlet passage 226 into the inlet chamber 104 through the through hole 237. The predetermined pressure, at which the relief valve 230 opens, is set to be greater than control pressure (set pressure) of a delivery valve (not shown). The delivery valve is provided to a high pressure fuel accumulator (not shown).

As referred to FIG. 11, the solenoid valve support 48, the inlet 50, the outlet 70, and the relief valve support 224 protrude outwardly beyond a position 228 of the outer circumferential periphery 43 of the cylinder 42. A base material among the solenoid valve support 48, the inlet 50, the outlet 70, the relief valve support 224, and the cylinder 42 may not be necessary in consideration of mechanical strength of the high pressure pump 220. In this structure, the unnecessary base material among these components can be reduced, so that the high pressure pump 220 can be reduced in size and weight. Furthermore, the base material can be reduced, so that manufacturing cost can be reduced.

As shown in FIGS. 12, 13, in the tenth embodiment, a high pressure pump 240 includes a pump housing 242. The pump housing 242 includes the cylinder 42, the tappet guide 44, the flange 46, the solenoid valve support 48, the inlet 50, the outlet 70, and a relief valve support (support member, external device support) 244 that are formed of a ferrous material such as stainless steel by monoblock casting. The relief valve support 244 accommodates the relief valve 230 that is substantially horizontally arranged. In this embodiment, the spring seat 236 of the relief valve 230 does not have a through hole. The downstream of the ball 232 in the relief valve 230 communicates with the inlet chamber 104 through a communication passage 246. When pressure in the downstream of the ball 72 in the outlet 70 becomes equal to or greater than predetermined pressure, the ball 232 is lifted against the bias force of the spring 234, so that fuel is exhausted from the outlet passage 226 into the inlet chamber 104 through the communication passage 246.

As referred to FIG. 13, the solenoid valve support 48, the inlet 50, the outlet 70, and the relief valve support 244 protrude outwardly beyond the position 228 of the outer circumferential periphery 43 of the cylinder 42. A base material among the solenoid valve support 48, the inlet 50, the outlet 70, the relief valve support 244, and the cylinder 42 may not be necessary in consideration of mechanical strength of the high pressure pump 240. In this structure, the unnecessary base material among these components can be reduced, so that the high pressure pump 240 can be reduced in size and weight. Furthermore, the base material can be reduced, so that manufacturing cost can be reduced.

Eleventh Embodiment, First and Second Modifications

Figure 14:
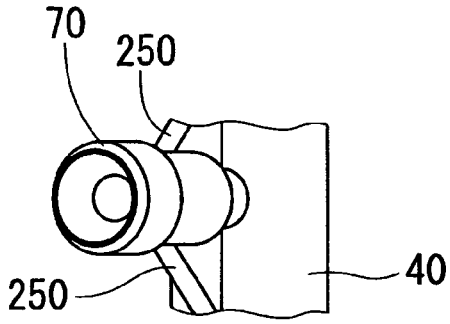
FIG. 14 is a perspective view showing ribs of a high pressure pump according to an eleventh embodiment.

As shown in FIG. 14, in the eleventh embodiment, ribs 250 are formed integrally with the outlet 70 in the pump housing 40 of the first embodiment in order to enhance mechanical strength of the outlet 70. Each of the ribs 250 substantially axially extends on the outer circumferential periphery of the outlet 70.

Figure 15:
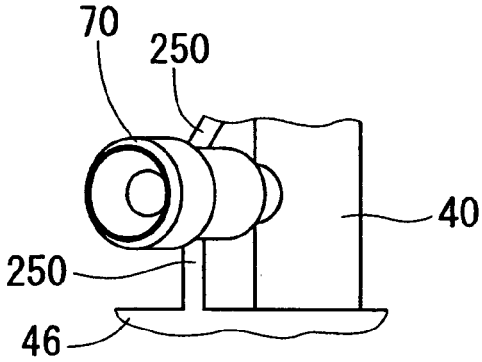
FIG. 15 is a perspective view showing ribs of a high pressure pump according to a first modification of the eleventh embodiment.

As shown in FIG. 15, in the first modification, one of the ribs 250, which substantially axially extends, is integrally formed with the flange 46 so that the rib 250 connects with the flange 46. In this structure, the rib 250 is integrally formed with both the flange 46 and the outlet 70, so that the rib 250 can be enhanced in strength.

Figure 16:
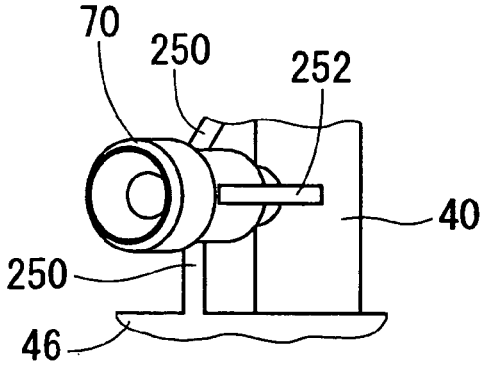
FIG. 16 is a perspective view showing ribs of a high pressure pump according to a second modification of the eleventh embodiment.
Figure 17:
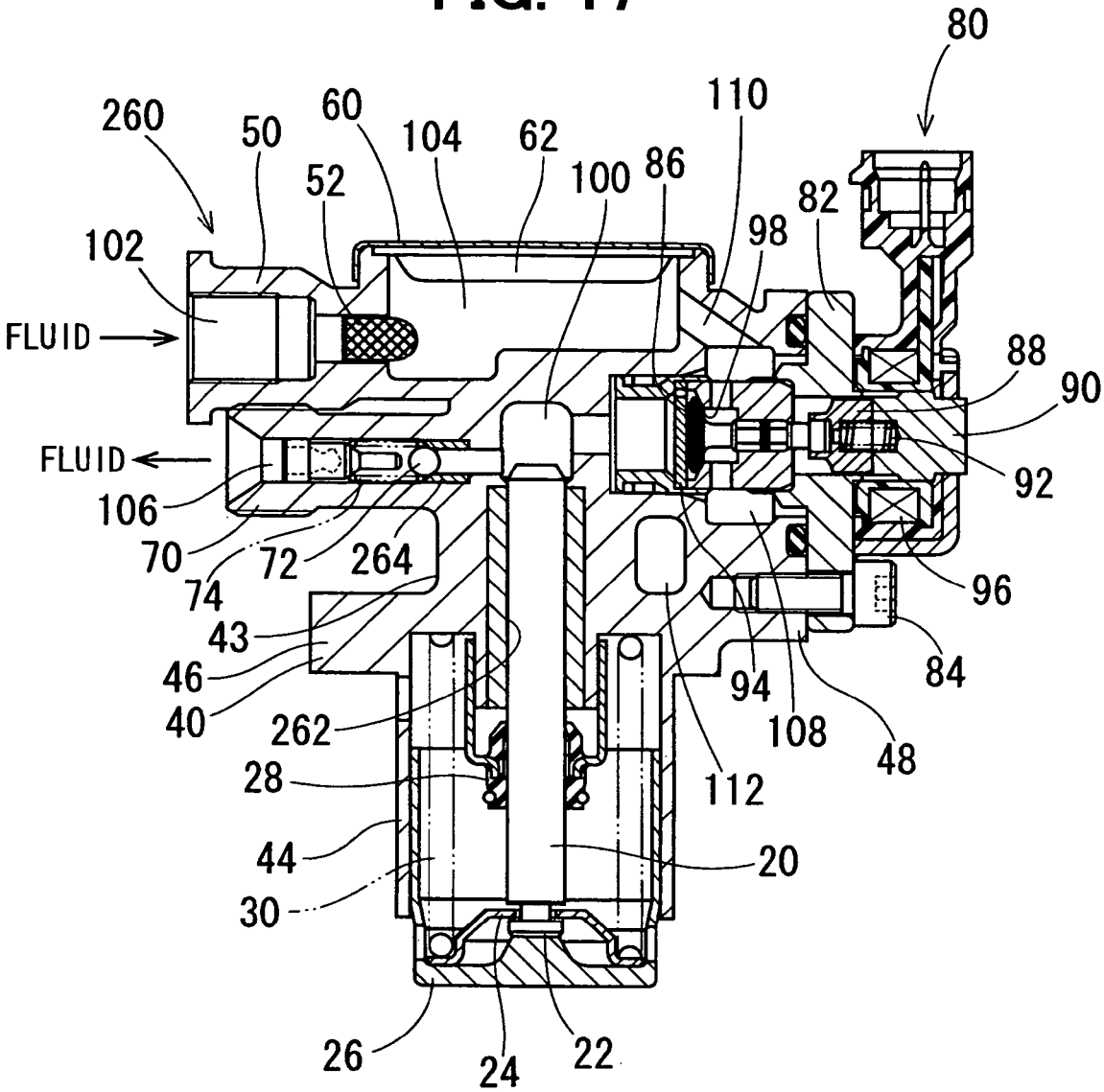
FIG. 17 is a partially longitudinal sectional view showing a high pressure pump according to a twelfth embodiment.
Figure 18:
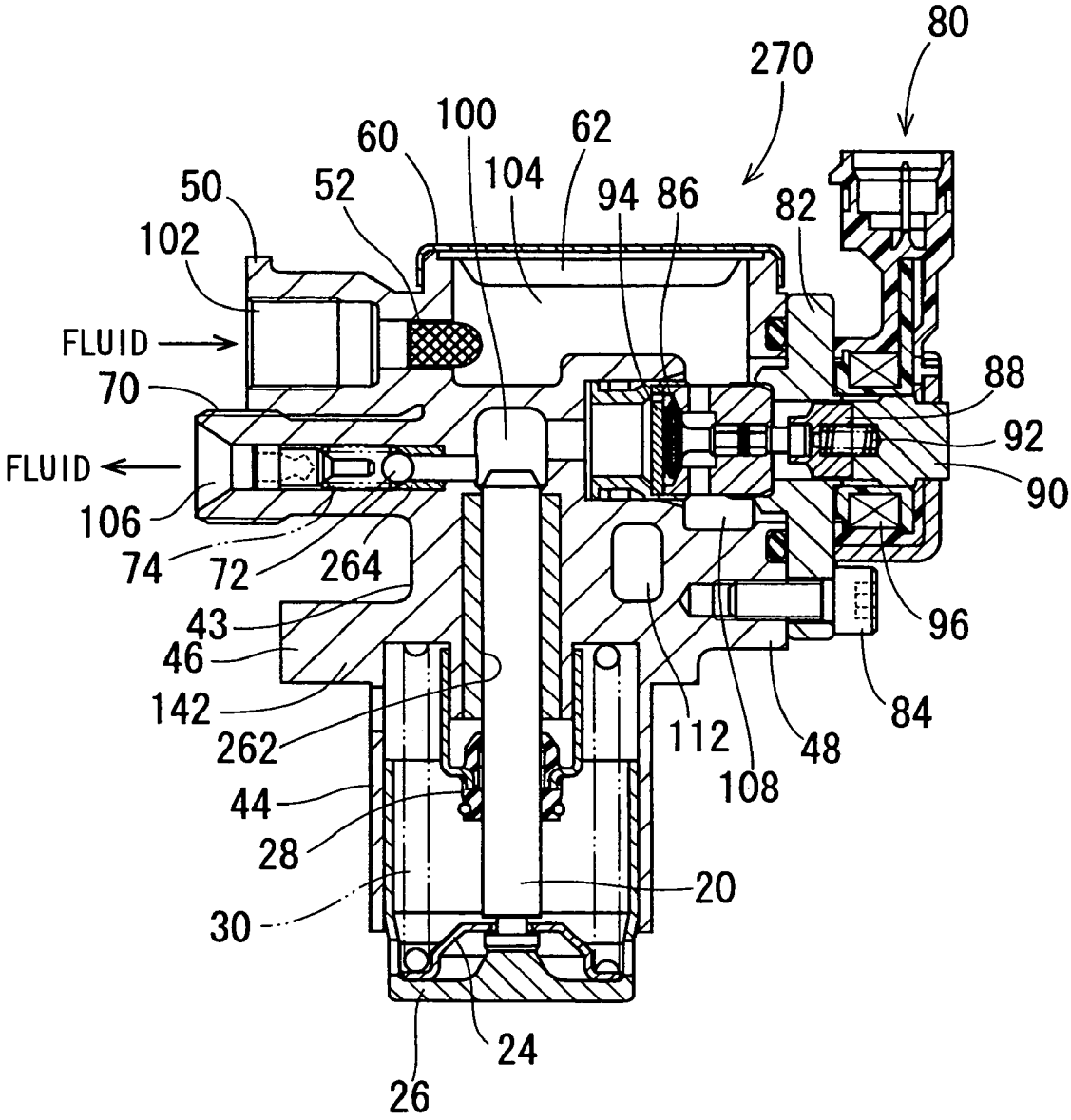
FIG. 18 is a partially longitudinal sectional view showing a high pressure pump according to a thirteenth embodiment.
Figure 19:
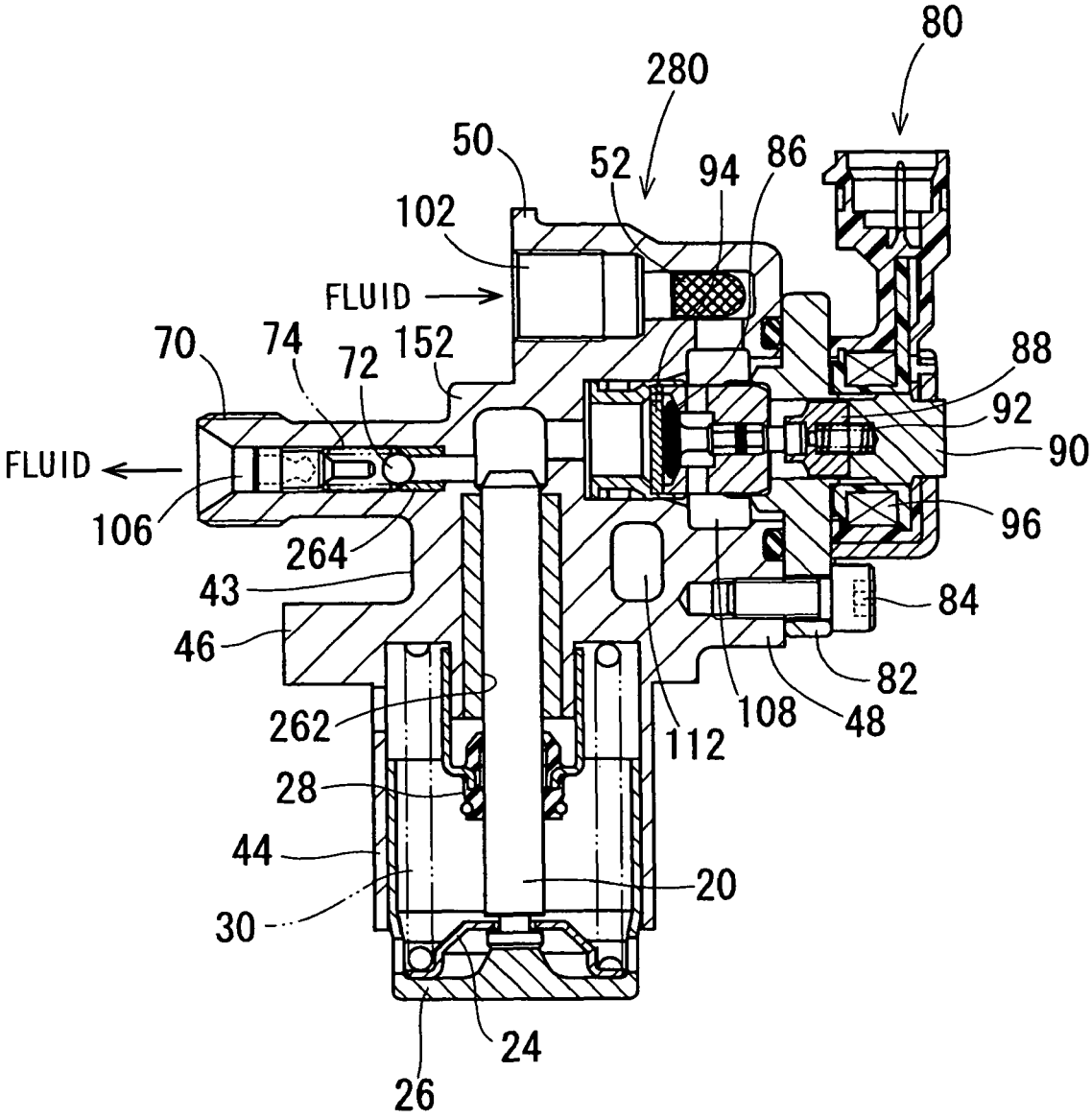
FIG. 19 is a partially longitudinal sectional view showing a high pressure pump according to a fourteenth embodiment.
Figure 20:
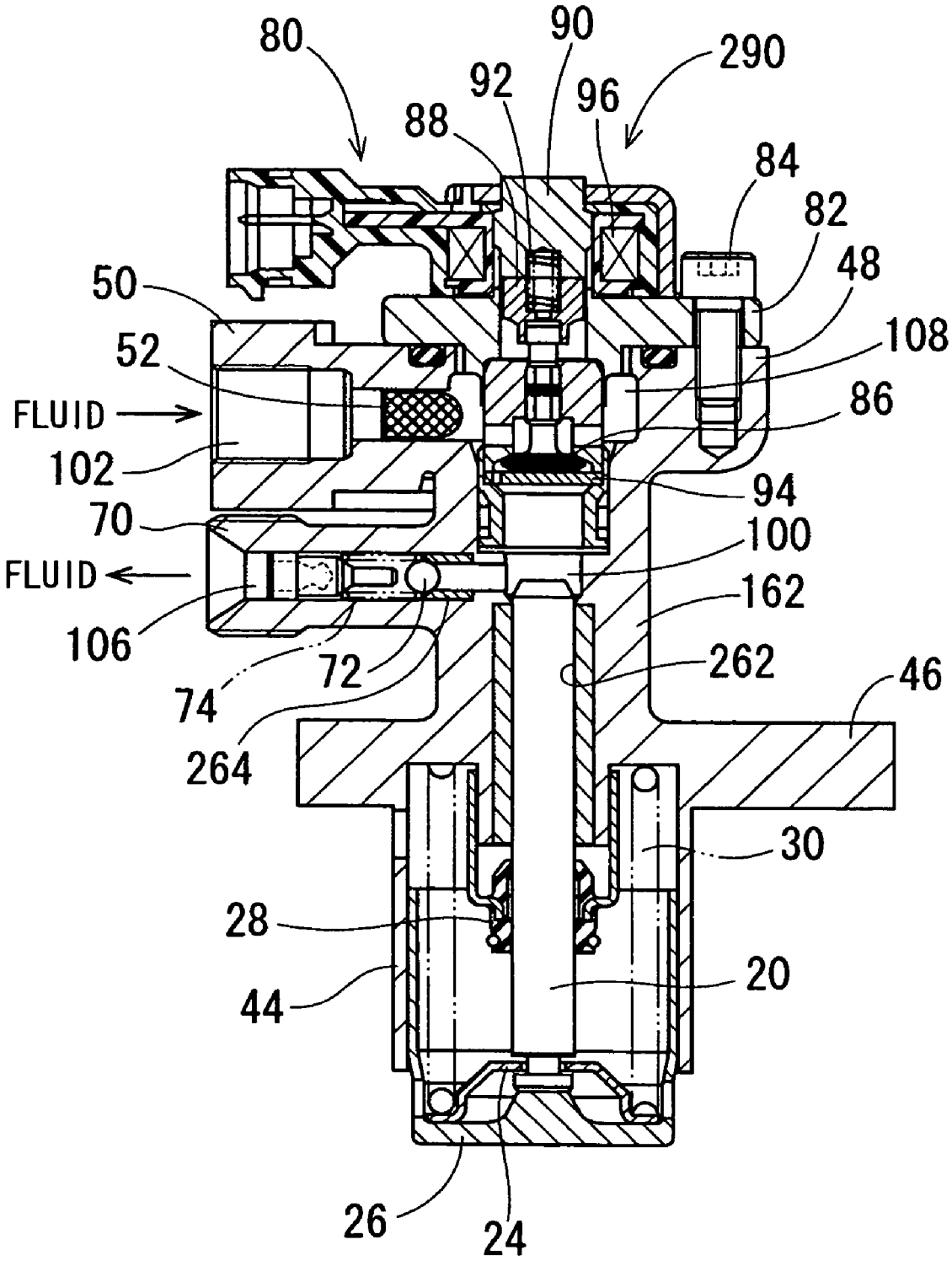
FIG. 20 is a partially longitudinal sectional view showing a high pressure pump according to a fifteenth embodiment.
Figure 21:
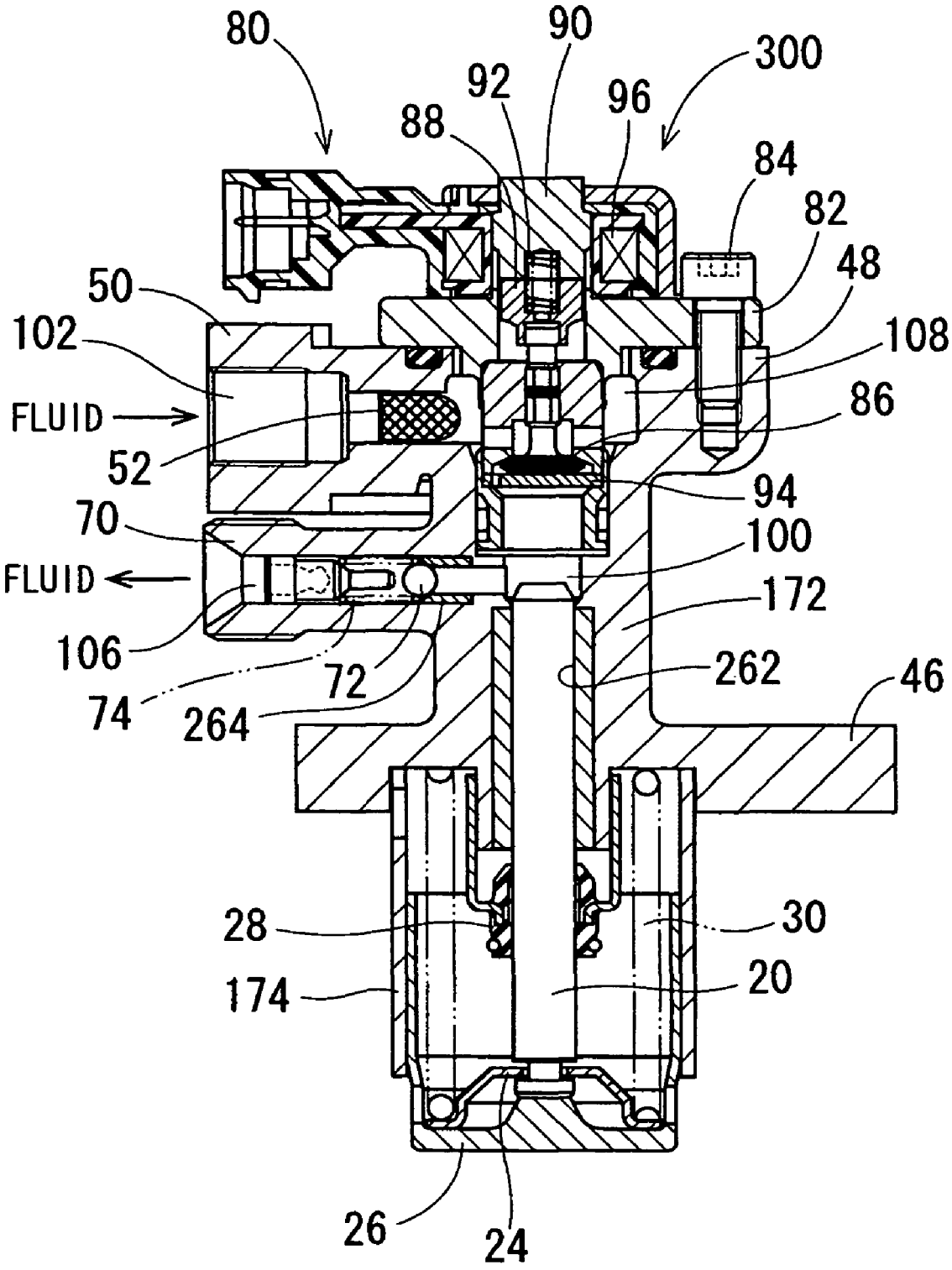
FIG. 21 is a partially longitudinal sectional view showing a high pressure pump according to a sixteenth embodiment.
Figure 22:
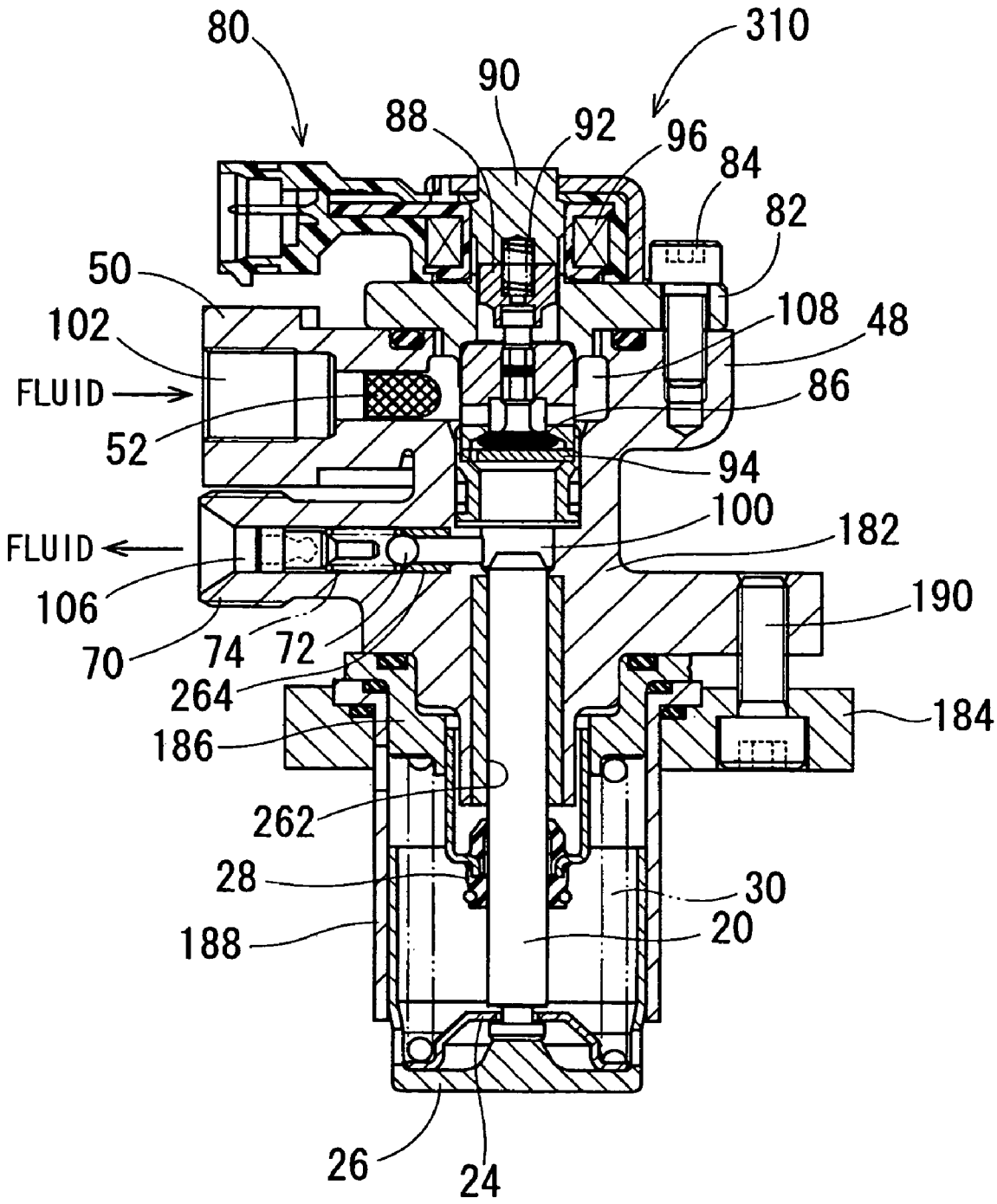
FIG. 22 is a partially longitudinal sectional view showing a high pressure pump according to a seventeenth embodiment.

As shown in FIG. 16, in the second modification, ribs 252 are formed integrally with the outlet 70, in addition to the ribs 250 of the first modification. The ribs 252 are substantially perpendicular to the ribs 250. The ribs 252 substantially axially extend on both sides of the outer circumferential periphery of the outlet 70.

Twelfth to Twentieth Embodiments

High pressure pump 260, 270, 280, 290, 300, 310, 320, 330, and 340 of the twelfth to twentieth embodiments respectively corresponds to the high pressure pump 10, 140, 150, 160, 170, 180, 200, 220, 240 of the first to seventh, ninth, and tenth embodiments.

In the twelfth to seventeenth, nineteenth, and twentieth embodiments, the solenoid valve support 48, the inlet 50, and the outlet 70 are formed integrally with the pump housing 40, 142, 152, 162, 172, 182, 222, 242. In the nineteenth, twentieth embodiments, the solenoid valve support 48 is not depicted in the figures. A cylinder 262, which axially and movably supports the plunger 20, and a valve seat 264, onto which the ball 72 is seated in the outlet 70, are components separate from the pump housing 40, 142, 152, 162, 172, 182, 222, 242.

In the twelfth to seventeenth, nineteenth, and twentieth embodiments, the pump housing 40, 142, 152, 162, 172, 182, 222, 242 is formed of a ferrous material such as low-carbon steel, austenitic stainless steel, and ferritic stainless steel by monoblock casting. In the twelfth to seventeenth, nineteenth, and twentieth embodiments, the cylinder 262, and the valve seat 264, onto which the ball 72 is seated in the outlet 70, are connected with the pump housing 40, 142, 152, 162, 172, 182, 222, 242 by connecting structure and method such as press-insertion, shrink fitting, expansion fitting, crimping, blazing, welding, and screwing, or a combination of these connecting structures and methods. The cylinder 262 and the valve seat 264 are formed of a material, such as martensitic stainless steel, being higher in hardness compared with the pump housing 40, 142, 152, 162, 172, 182, 222, 242.

Figure 23:
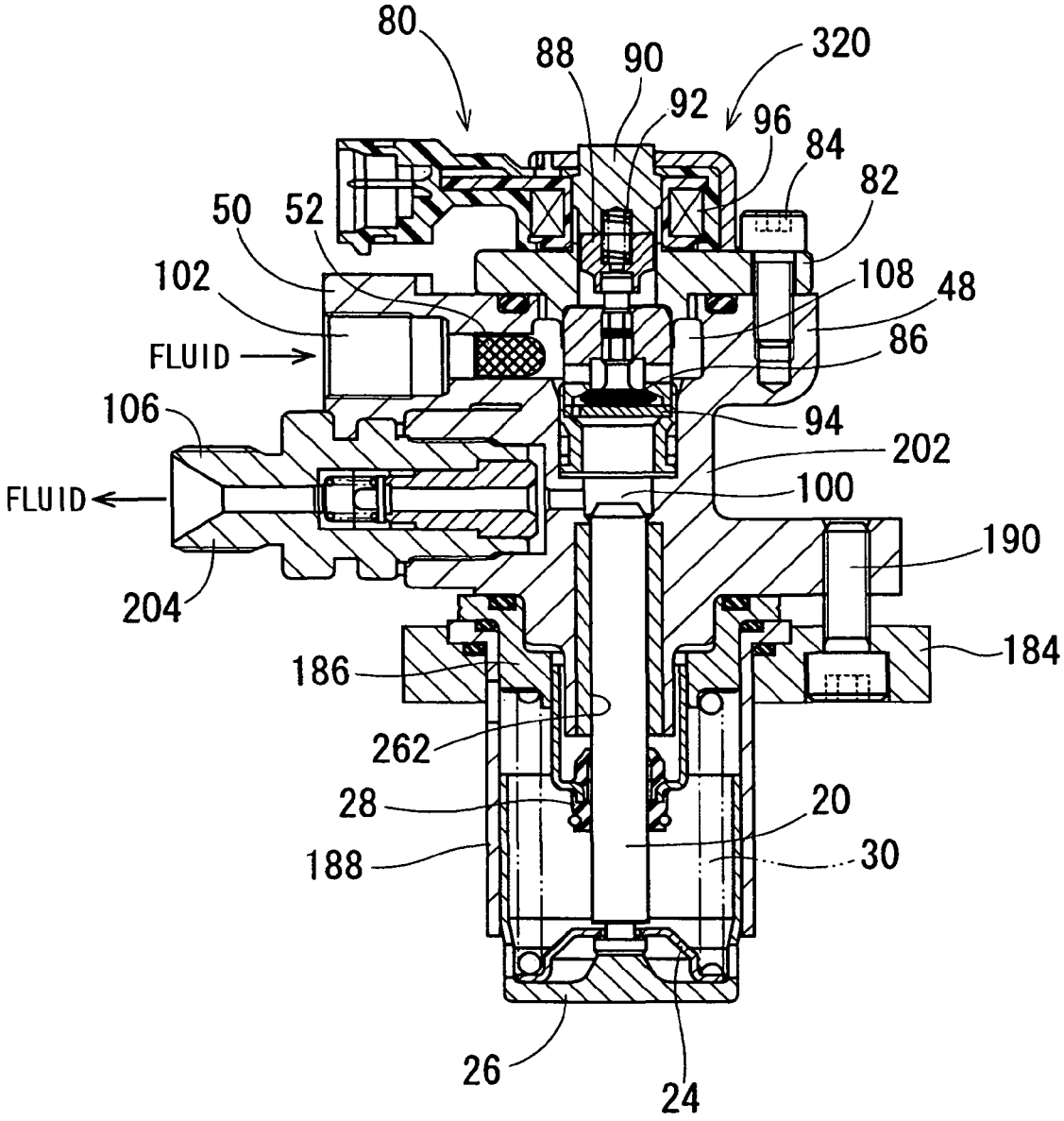
FIG. 23 is a partially longitudinal sectional view showing a high pressure pump according to an eighteenth embodiment.
Figure 24:
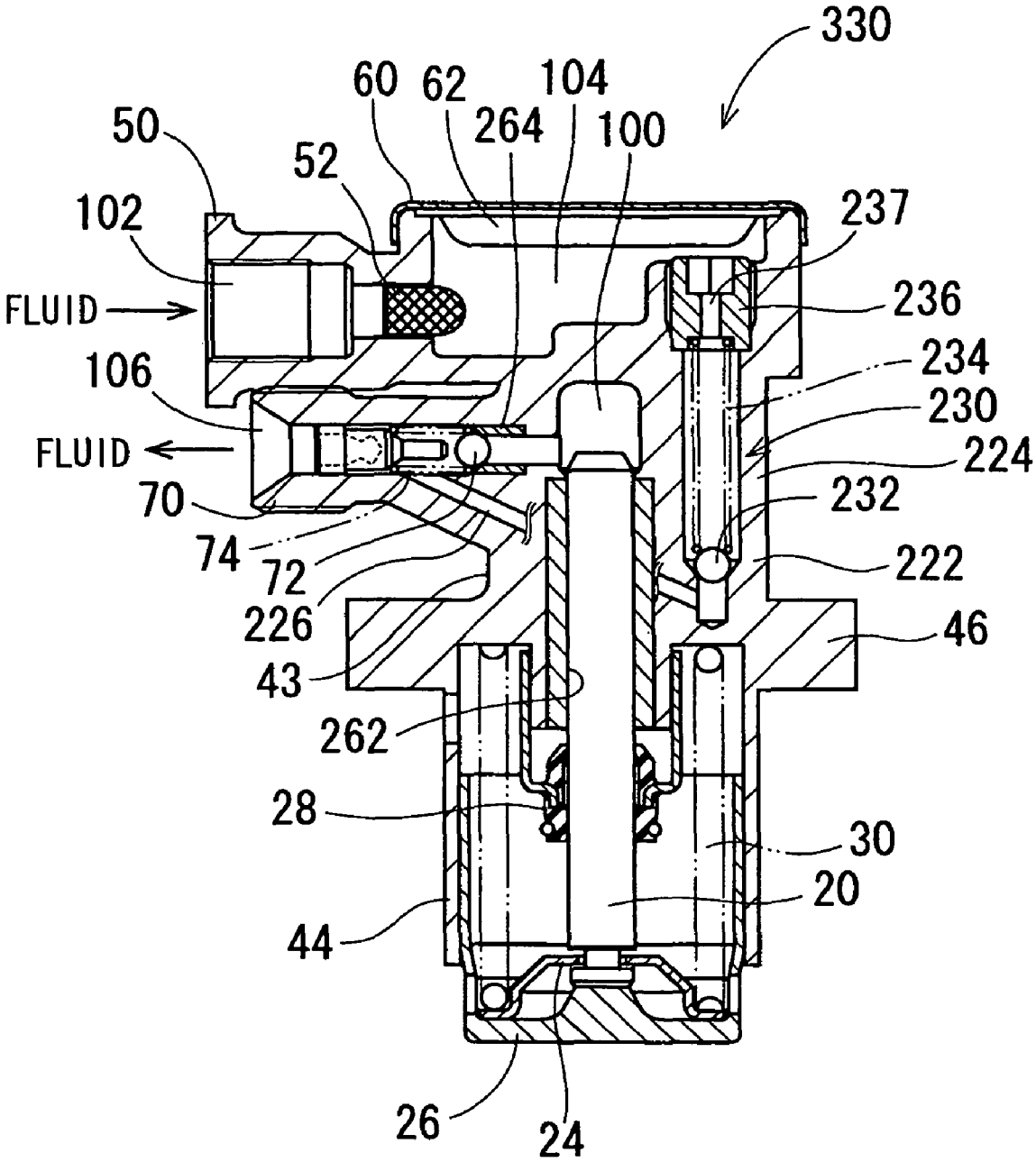
FIG. 24 is a partially longitudinal sectional view showing a high pressure pump according to a nineteenth embodiment.
Figure 25:
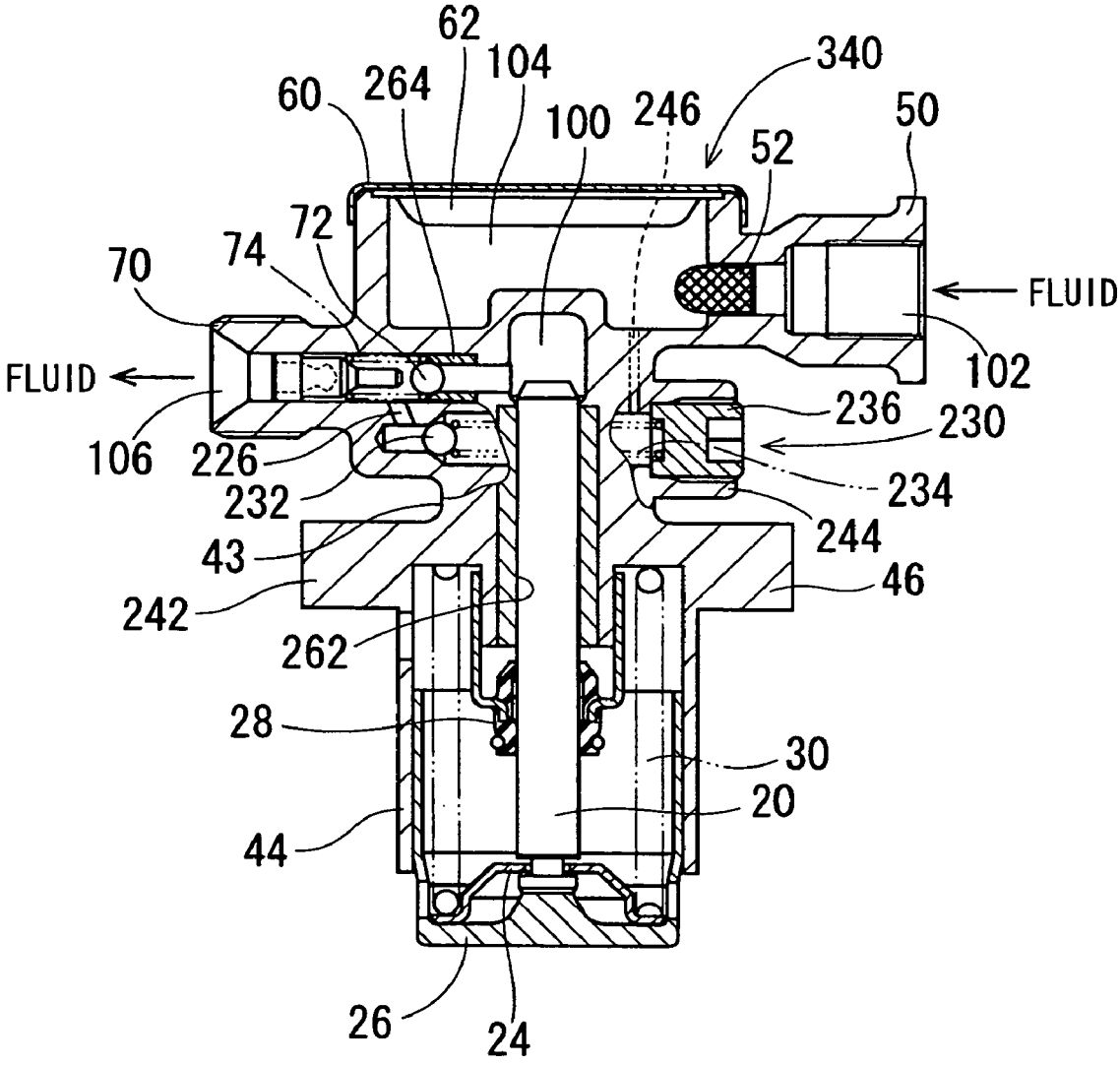
FIG. 25 is a partially longitudinal sectional view showing a high pressure pump according to a twentieth embodiment.
Figure 26:
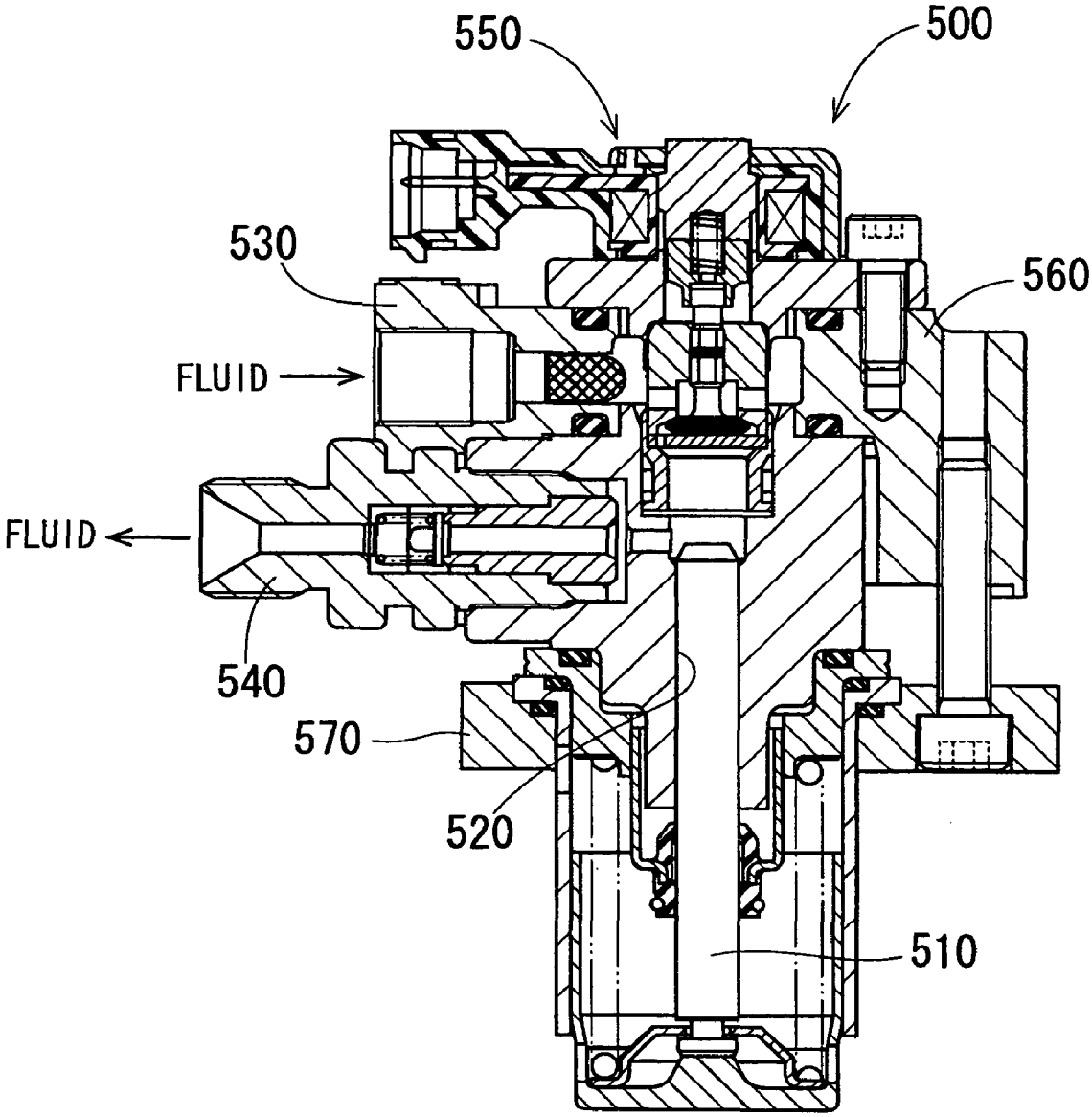
FIG. 26 is a partially longitudinal sectional view showing a high pressure pump according to a related art.
Figure 27:
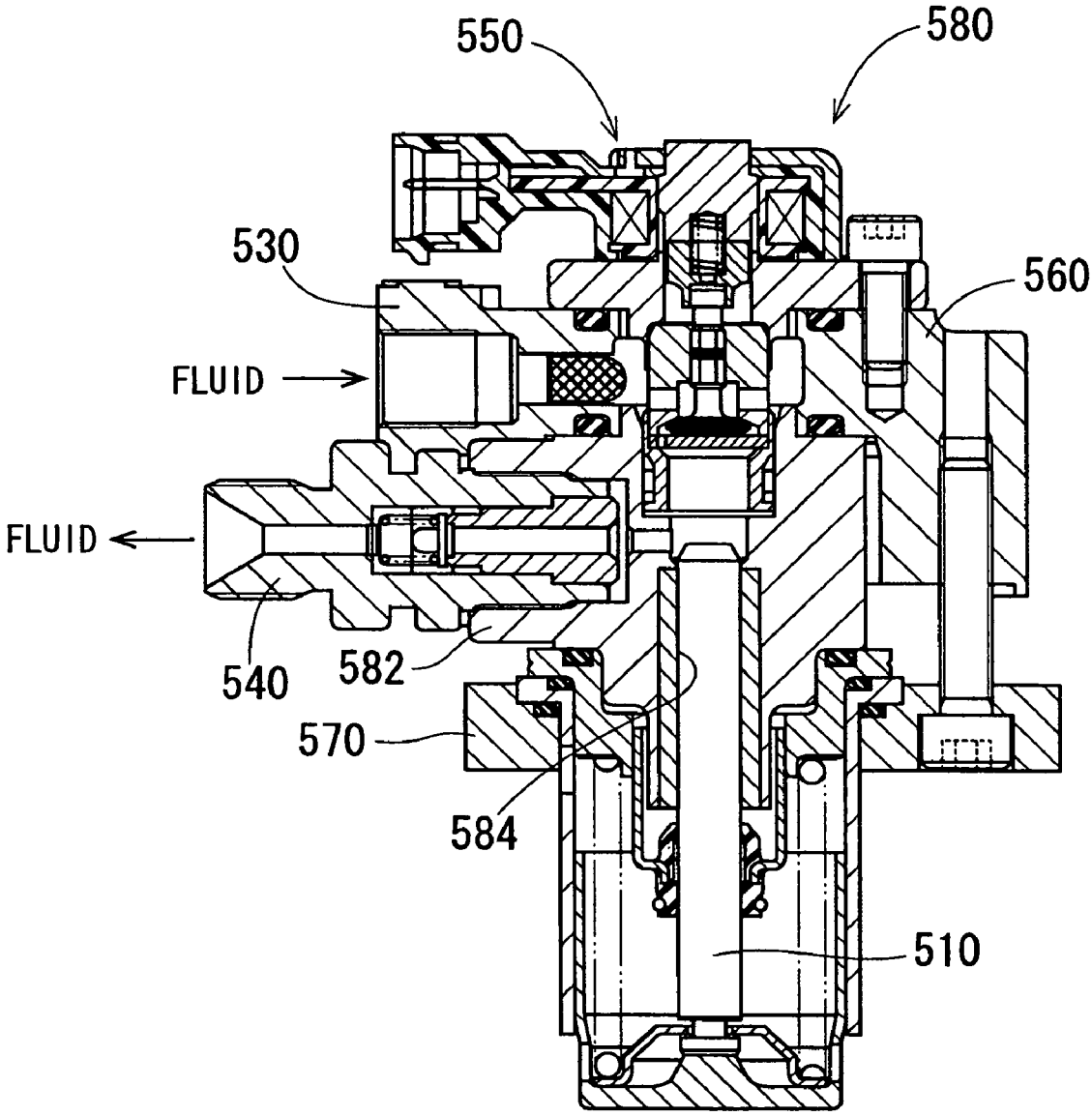
FIG. 27 is a partially longitudinal sectional view showing a high pressure pump according to a related art.

As shown in FIG. 23, in the eighteenth embodiment, whole of a delivery valve, which constructs the outlet 204, and the cylinder 262 are components separate from the pump housing 202. The inlet 50 and the solenoid valve support 48 are formed integrally with the pump housing 202. The pump housing 202 of the eighteenth embodiment is formed of a ferrous material such as low-carbon steel, austenitic stainless steel, and ferritic stainless steel by monoblock casting, similarly to the twelfth to seventeenth, nineteenth, and twentieth embodiments. The cylinder 262 is formed of a material, such as martensitic stainless steel, being higher in hardness compared with the pump housing 202.

The plunger slides relative to the cylinder. The valve member of the check valve is repeatedly seated onto and lifted from the valve seat of the check valve, which is provided to the outlet. Accordingly, the cylinder and the valve seat needs hardness higher than hardness of the inlet, the outlet, and the solenoid valve support.

Thus, the cylinder, the valve seat, the inlet, the outlet, and the solenoid valve support, which are different in hardness, are integrally formed by monoblock casting. In this structure, whole of this monoblock product may be formed of a material, which is high in hardness, in conformity with hardness of the cylinder and the valve seat. Alternatively, whole of this monoblock product may be formed of a relatively soft material in conformity with the inlet, the outlet, and the solenoid valve support. Subsequently, the cylinder and the check valve may be applied with hardening treatment such as quenching and plating to partially enhance hardness of the monoblock product. The relatively soft material is lower in hardness compared with required hardness of the cylinder and the check valve.

However, when whole of the monoblock product is formed of a hard material, the inlet, the outlet, and the solenoid valve support, which may be formed of a relatively soft material, are also formed of the hard material. In general, a hard material is expensive. Accordingly, when consumption of a hard material increases, manufacturing cost may increase. By contrast, when the monoblock product is formed of a relatively soft material, and the cylinder and the check valve are applied with hardening treatment in the monoblock product, the hardening treatment may be complicated, and manufacturing cost of the high pressure pump may increase.

Thus, in the corresponding embodiments, at least one of the cylinder and the valve seat is formed separately from the monoblock product, i.e., pump housing, and are formed of a material, which is higher in hardness compared with the monoblock product. In this structure, the monoblock product is formed of a material, which is softer than the at least one of the cylinder and the valve seat. Therefore, consumption of hard and expensive material can be reduced, so that manufacturing cost of the high pressure pump can be reduced.

In the above twelfth to twentieth embodiments, at least two of the inlet, the outlet, and the solenoid valve support are integrally formed to construct the pump housing. Therefore, the number of the components constructing the high pressure pump can be reduced. Therefore, manufacturing work of the high pressure pump can be reduced. In addition, the number of sealed components can be reduced, so that fuel can be restricted from leaking through sealed components. Thus, fuel can be restricted from leaking through sealed components.

In the twelfth to twentieth embodiments, the pump housing 40, 142, 152, 162, 172, 182, 202, 222, 242 are formed of a low-hardness and low-cost material such as low-carbon steel, austenitic stainless steel, and ferritic stainless steel. Therefore, manufacturing cost of the pump housing can be reduced. Low-carbon steel, austenitic stainless steel, and ferritic stainless steel contain carbon less than martensitic stainless steel, which may be formed to be the cylinder 262 and the valve seat 264. Therefore, low-carbon steel, austenitic stainless steel, and ferritic stainless steel are not apt to cause a crack in welding work. Consequently, a welded portion between the pump housing 40, 142, 152, 162, 172, 182, 202, 222, 242 and another component has high reliability, so that weldability of the components can be enhanced. Thus, the welded portion can be enhanced in strength and sealing performance.

In the twelfth to twentieth embodiments, the pump housing 40, 142, 152, 162, 172, 182, 202, 212, 222, 242 are formed by monoblock casting. Therefore, integral product can be readily formed to be a predetermined shape, compared with machining work or cold forging. In particular, recessed portion of the pump housing can be readily formed by casting.

In the corresponding embodiments, at least one of the inlet, the outlet, and the solenoid valve support, which is integrally formed with the cylinder, protrudes outwardly from the outer periphery of the cylinder. In this structure, an unnecessary base material around the protruding member can be reduced. Therefore, the integrally formed product, i.e., monoblock cast product of the pump housing can be reduced in size and weight. Therefore, manufacturing cost of the high pressure pump can be reduced.

Other Embodiment

In the above first to eleventh embodiments, the outlet serves as the joint, for a high pressure piping, and also serves a delivery valve. Alternatively, the outlet may only serve as the joint for a high pressure piping.

In the ninth and tenth embodiments, the pump housing 222, 242 are formed by monoblock casting, similarly to the first to eighth embodiments. Alternatively, the pump housing 222, 242 in the ninth and tenth embodiments may be integrally formed by another method such as cold forging.

In the eleventh embodiment, first and second modifications, the ribs 250, 252 are integrally formed on the outer circumferential periphery of the outlet 70. Alternatively, when the cylinder 42 and at least one of the inlet and the solenoid valve support are integrally formed, the outer circumferential periphery of at least one of the inlet and the solenoid valve support may be formed integrally with a rib to enhance strength of the at least one of the inlet and the solenoid valve support.

In the twelfth to twentieth embodiments, the pump housing 40, 142, 152, 162, 172, 182, 202, 222, 242 are formed by monoblock casting. Alternatively, the pump housing 40, 142, 152, 162, 172, 182, 202, 222, 242 may be integrally formed by another method such as cold forging.

In the twelfth to twentieth embodiments, both the valve seat of the delivery valve and the cylinder are separately cast. Alternatively, either the valve seat of the delivery valve or the cylinder may be formed integrally with the pump housing by monoblock casting. In this case, either the valve seat of the delivery valve or the cylinder, which is formed integrally with the pump housing, may be enhanced in hardness by quenching, plating, or the like.

In the above embodiments, the amount of fuel discharged from the high pressure pump 10 is controlled by operating the solenoid valve to communicate and block the fuel passage on the side of the inlet of the compression chamber 100. The location of the solenoid valve (control valve) is not limited to those in the structures of the above embodiments. The control valve may be arranged at any location in the fuel passage between the inlet and the outlet of the high pressure pump. For example, the control valve may be provided to the fuel passage on the side of the outlet with respect to the compression chamber to control the amount of discharged fuel.

The above structures of the embodiments can be combined as appropriate. For example, the ribs 250, 252 of the eleventh embodiment may be applied to the structures of any other embodiments.

In the above embodiments, the above structures are applied to the high pressure fuel pump. However, the above structures can be applied to any other fluid pumps.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A fluid pump comprising:

an inlet;

a plunger that is movable to pressurize fluid drawn from the inlet into a compression chamber;

a housing having a cylinder in which the plunger is substantially axially movable and an outlet defining a bore through which fluid pressurized in the compression chamber is discharged, the inlet and the outlet defining a fluid passage therebetween;

a check valve that permits fluid to be discharged through the outlet and restricts fluid from flowing into the compression chamber from the outlet, wherein the check valve includes:

a valve seat, which is defined in the outlet; and a valve member, which is seatable against the valve seat to restrict the fluid from flowing into the compression chamber from the outlet and is liftable away from the valve seat to permit the fluid to be discharged through the outlet;

a solenoid control valve that selectively communicates or blocks the fluid passage to control fluid discharged through the outlet; and a support member that supports the control valve, wherein the cylinder, the valve seat, the support member, the inlet, and the outlet are integrally formed as a single part, wherein an outlet passage radially outwardly extends from the compression chamber, through the valve seat, to an outlet opening along an imaginary straight radial line and includes the bore of the outlet, wherein the outlet serves as a joint adapted to connect with a high pressure pipe, and wherein the outlet protrudes radially outwardly from a remainder of the housing.

2. The fluid pump according to claim 1, wherein the housing is formed of a ferrous material by monoblock casting.

3. The fluid pump according to claim 1, wherein the valve member is a ball, wherein the check valve further includes a spring, which urges the ball against the valve seat, and wherein:

when pressure in the compression chamber becomes equal to or greater than a predetermined pressure, the ball is lifted from the valve seat against bias force of the spring, so that high pressure fuel in the compression chamber is discharged from the outlet, and when the ball is seated onto the valve seat, fuel is restricted from causing counterflow from the outlet into the compression chamber.

4. The fluid pump according to claim 1, wherein the outlet is adapted to be connected with the high pressure pipe from radially outside the housing.

5. The fluid pump according to claim 4, wherein the outlet has a male thread defined on an outer circumferential surface thereof.

6. The fluid pump according to claim 1, wherein the cylinder, the valve seat and the outlet are seamlessly connected together in the housing.

* * * * *